US011414804B2

(12) United States Patent
Cho et al.

(10) Patent No.: US 11,414,804 B2
(45) Date of Patent: Aug. 16, 2022

(54) WASHING MACHINE DRUM ASSEMBLY, WASHING MACHINE INCLUDING THE SAME, AND METHOD OF PRODUCING THE SAME

(71) Applicant: Samsung Electronics Co., Ltd., Suwon-si (KR)

(72) Inventors: Youngjin Cho, Suwon-si (KR); Kanghyun Lee, Suwon-si (KR); Jeoungkyo Jeoung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 79 days.

(21) Appl. No.: 16/734,736

(22) Filed: Jan. 6, 2020

(65) Prior Publication Data

US 2021/0062387 A1 Mar. 4, 2021

(30) Foreign Application Priority Data

Aug. 28, 2019 (KR) ..... 10-2019-0105697

(51) Int. Cl.

| | |
|---|---|
| ***D06F 37/22*** | (2006.01) |
| ***D06F 21/04*** | (2006.01) |
| ***D06F 37/04*** | (2006.01) |
| *D06F 37/12* | (2006.01) |

(Continued)

(52) U.S. Cl.

CPC ..... *D06F 37/22* (2013.01); *D06F 21/04* (2013.01); *D06F 37/04* (2013.01); *D06F 37/12* (2013.01); *D06F 37/24* (2013.01); *D06F 37/26* (2013.01)

(58) Field of Classification Search

CPC ..... D06F 21/04

See application file for complete search history.

(56) References Cited

U.S. PATENT DOCUMENTS 5,746,070 A * 5/1998 Bailey ..... D06F 37/04 34/322
5,765,404 A * 6/1998 Fanson ..... D06F 37/24 68/23.2
7,444,843 B2 11/2008 Ozturk et al.

(Continued)

FOREIGN PATENT DOCUMENTS

KR 1999-000540 1/1999
KR 10-0805231 2/2008

(Continued)

OTHER PUBLICATIONS

"Samsung Showcases the Future of Connected Living at CES 2019", Jan. 7, 2019, Samsung.com.

*Primary Examiner* — Joseph L. Perrin
(74) *Attorney, Agent, or Firm* — Staas & Halsey LLP

(57) ABSTRACT

A washing machine drum assembly includes: a drum having a hollow cylindrical shape, including a front end flange formed at a front end of the drum and a rear end flange formed at a rear end of the drum, and including a plurality of coupling holes formed adjacent to the rear end flange; a front surface plate mounted on the front end of the drum; and a rear surface plate mounted on the rear end of the drum and including a plurality of rear surface holes corresponding to the plurality of coupling holes of the drum, wherein a rear end positioning mechanism configured to position the rear surface plate with respect to the drum is formed in the rear end flange of the drum and the rear surface plate.

15 Claims, 35 Drawing Sheets

(51) Int. Cl.
*D06F 37/24* (2006.01)
*D06F 37/26* (2006.01)

(56) References Cited

U.S. PATENT DOCUMENTS

| | | | | |
|---|---|---|---|---|
| 7,506,425 | B2 * | 3/2009 | Kim | D06F 37/04 29/509 |
| 2005/0103060 | A1 * | 5/2005 | Ozturk | D06F 37/04 68/3 R |
| 2009/0293551 | A1 * | 12/2009 | Lee | D06F 37/04 68/23.2 |
| 2011/0126596 | A1 * | 6/2011 | Kim | D06F 37/225 68/140 |
| 2016/0348295 | A1 * | 12/2016 | Bae | D06F 37/225 |
| 2020/0181825 | A1 * | 6/2020 | Lasner | D06F 37/04 |

FOREIGN PATENT DOCUMENTS

| | | |
|---|---|---|
| KR | 10-1428485 | 8/2014 |
| KR | 10-2015-0074758 | 7/2015 |

* cited by examiner

WASHING MACHINE DRUM ASSEMBLY, WASHING MACHINE INCLUDING THE SAME, AND METHOD OF PRODUCING THE SAME

CROSS-REFERENCE TO RELATED APPLICATION(S)

This application is based on and claims priority under 35 U.S.C. § 119 to Korean Patent Application No. 10-2019-0105697, filed on Aug. 28, 2019, in the Korean Intellectual Property Office, the disclosure of which is incorporated by reference herein in its entirety.

BACKGROUND OF THE INVENTION

Field of the Invention

Apparatuses and methods consistent with the disclosure relate to a washing machine, and more particularly, to a drum assembly used for a washing machine, a washing machine including the same, and a method of producing the same.

Description of the Related Art

In general, a washing machine includes a washing tub in which water is received at the time of washing. The washing tub is formed to prevent escape of laundry and transfer power.

Such a washing tub may be implemented by a drum assembly including a drum having a cylindrical shape, a front surface plate mounted on a front end of the drum, and a rear surface plate mounted on a rear end of the drum.

In case of the washing machine according to the related art, the front surface plate and the rear surface plate are inserted into the front end and the rear end of the drum having a cylindrical shape, respectively, at the time of producing the drum assembly. Then, the front surface plate and the rear surface plate are each fixed to a seaming jig and are coupled to the front end and the rear end of the drum, respectively, by rotating the drum.

Here, a plurality of holes for fixing a flange shaft are formed in each of a rear end portion of the drum and the rear surface plate. The plurality of holes of the rear surface plate need to be aligned with the plurality of holes of the rear end portion of the drum at the time of fixing the rear surface plate to the rear end of the drum.

Therefore, in case that a worker misaligns the plurality of holes of the rear surface plate with the plurality of holes of the rear end portion of the drum in a process of producing the drum assembly, a washing tub producing defect that a screw or a bolt is not completely fastened at the time of mounting the flange shaft on the rear surface plate occurs.

Alternatively, the washing tub producing defect occurs in case that the rear surface plate slips with respect to the drum due to a rotational force in a seaming process in which the rear surface plate is coupled to the rear end of the drum.

As such, in case that the plurality of holes of the drum and the plurality of holes of the rear surface plate are misaligned with one another, a producing defect that a screw or a bolt is not fastened at all or is not completely fastened at the time of fixing the flange shaft to the rear surface plate by using the screw or the bolt may occur.

SUMMARY OF THE INVENTION

Embodiments of the disclosure overcome the above disadvantages and other disadvantages not described above.

Also, the disclosure is not required to overcome the disadvantages described above, and an embodiment of the disclosure may not overcome any of the problems described above.

The disclosure provides a washing machine drum assembly having a structure capable of easily aligning a plurality of holes of a rear surface plate or a front surface plate with a plurality of holes of a drum and preventing the rear surface plate or the front surface plate from slipping with respect to the drum when a worker disposes the rear surface plate or the front surface plate at the drum.

Further, the disclosure provides a washing machine including the drum assembly and a method of producing the drum assembly.

According to an embodiment of the disclosure, a washing machine drum assembly includes: a drum having a hollow cylindrical shape, including a front end flange formed at a front end of the drum and a rear end flange formed at a rear end of the drum, and including a plurality of coupling holes formed adjacent to the rear end flange; a front surface plate mounted on the front end of the drum; and a rear surface plate mounted on the rear end of the drum and including a plurality of rear surface holes corresponding to the plurality of coupling holes of the drum, wherein a rear end positioning mechanism configured to position the rear surface plate with respect to the drum is formed in the rear end flange of the drum, and the rear surface plate.

According to another embodiment of the disclosure, a method of producing a washing machine drum assembly includes: forming a drum sheet having a flat plate shape by press processing; forming a drum by bending the drum sheet in a cylindrical shape and bonding opposite side ends of the drum sheet by welding; forming a front end flange and a rear end flange by bending opposite ends of the drum at 90 degrees; inserting a front surface plate into a front end of the drum; inserting a rear surface plate into a rear end of the drum; and coupling the front surface plate and the rear surface plate to the drum by using a seaming jig, wherein at least one notch is formed in the rear end flange of the drum, at least one protrusion corresponding to the at least one notch is formed in the rear surface plate, and the at least one protrusion of the rear surface plate is inserted into the at least one notch of the rear end flange at the time of inserting the rear surface plate into the rear end of the drum.

BRIEF DESCRIPTION OF THE DRAWING FIGURES

The above and/or other embodiments of the disclosure will be more apparent by describing certain embodiments of the disclosure with reference to the accompanying drawings, in which.

DETAILED DESCRIPTION OF THE EXEMPLARY EMBODIMENTS

Figure 1:
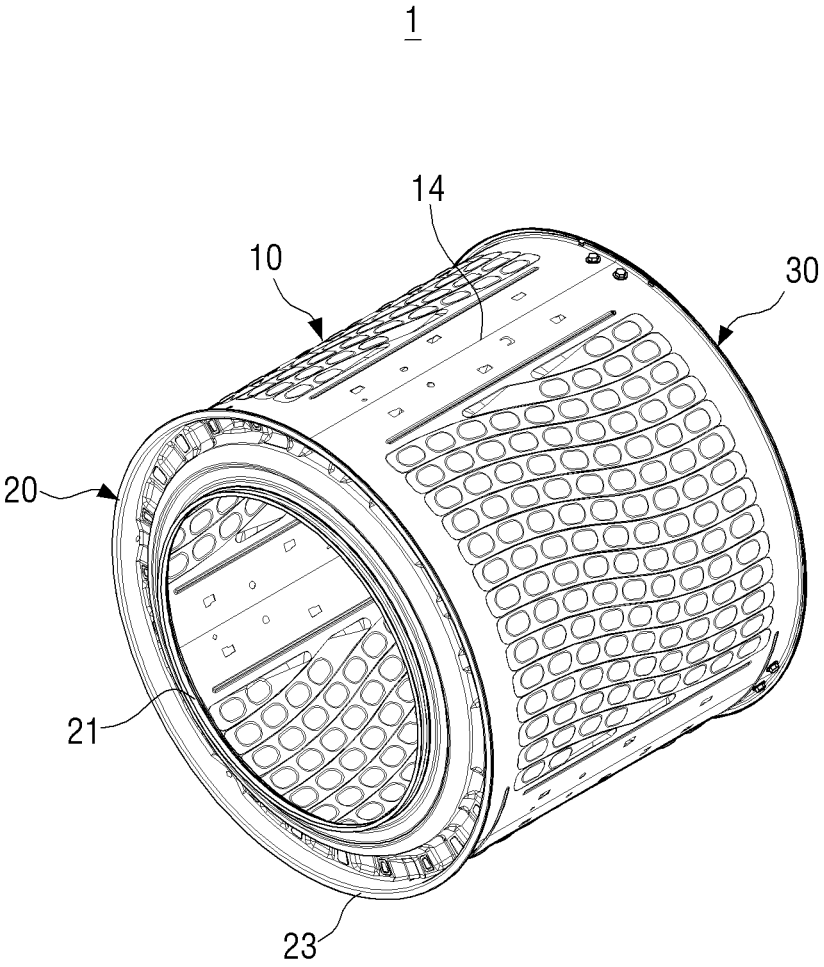
FIG. 1 is a perspective view illustrating a washing machine drum assembly according to an embodiment of the disclosure.

Various embodiments of the disclosure will hereinafter be described with reference to the accompanying drawings. However, it is to be understood that technologies mentioned in the disclosure are not limited to specific embodiments, but include various modifications, equivalents, and/or alternatives according to embodiments of the disclosure. Throughout the accompanying drawings, similar components will be denoted by similar reference numerals. Further, the accompanying drawings are not illustrated to scale, but sizes of some of components may be exaggerated to assist in the understanding of the disclosure.

In addition, expressions "first", "second", or the like, used in the disclosure may indicate various components regardless of a sequence and/or importance of the components, will be used only to distinguish one component from the other components, and do not limit the corresponding components. For example, a first user device and a second user device may indicate different user devices regardless of a sequence or importance thereof. For example, a first component may be named a second component and the second component may also be similarly named the first component, without departing from the scope of the disclosure.

Terms used in the disclosure may be used only to describe specific embodiments rather than restricting the scope of other embodiments. Singular forms may include plural forms unless the context clearly indicates otherwise. Terms used in the specification including technical and scientific terms have the same meanings as those that are generally understood by those skilled in the art to which the disclosure pertains. Terms defined in a general dictionary among terms used in the disclosure may be interpreted as meanings that are the same as or similar to meanings within a context of the related art, and are not interpreted as ideal or excessively formal meanings unless clearly defined in the disclosure. In some cases, terms may not be interpreted to exclude embodiments of the disclosure even though they are defined in the disclosure.

Hereinafter, a washing machine drum assembly according to an embodiment of the disclosure will be described in detail with reference to the accompanying drawings.

Figure 2:
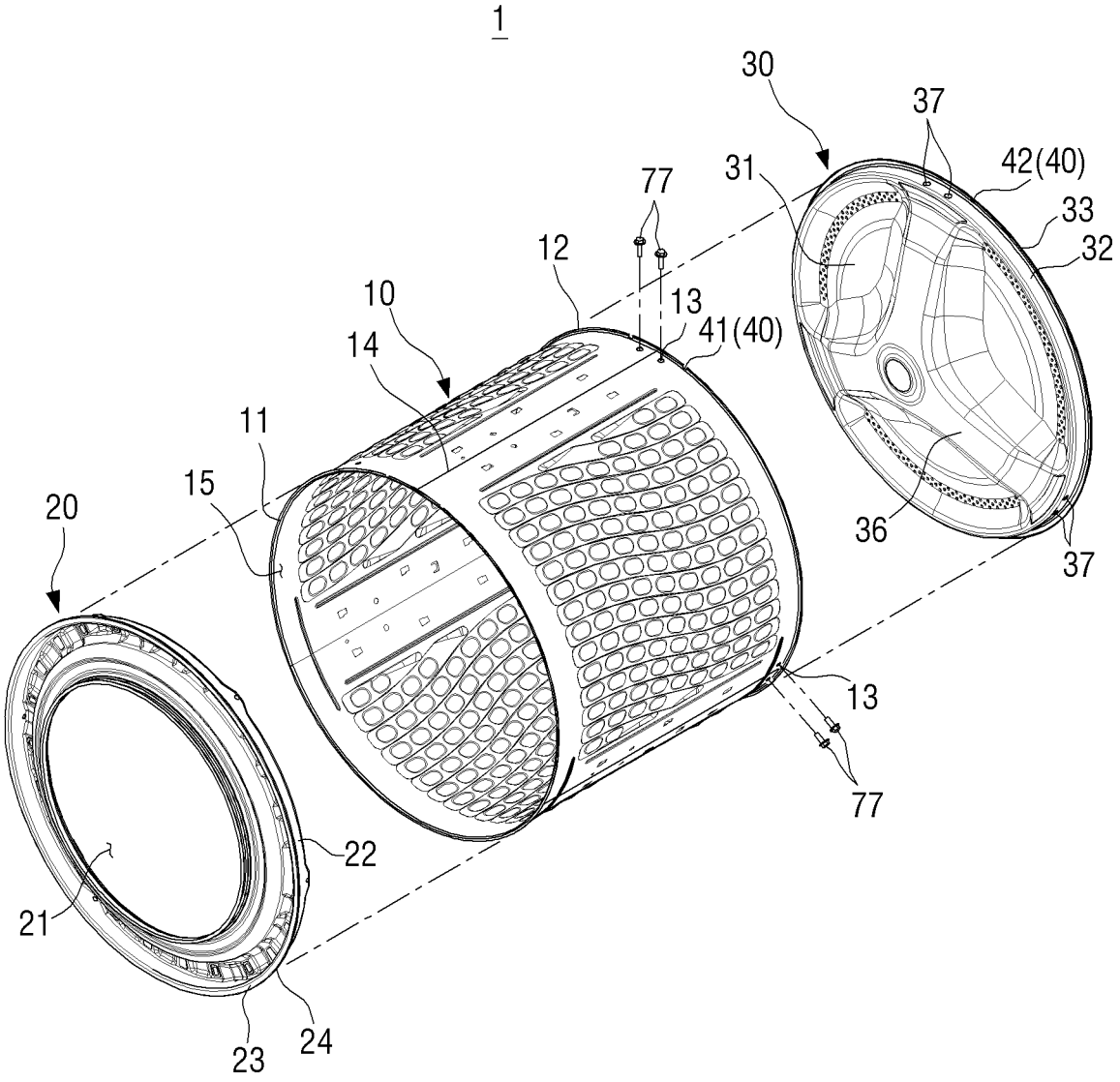
FIG. 2 is an exploded perspective view of the washing machine drum assembly of FIG. 1.
Figure 3:
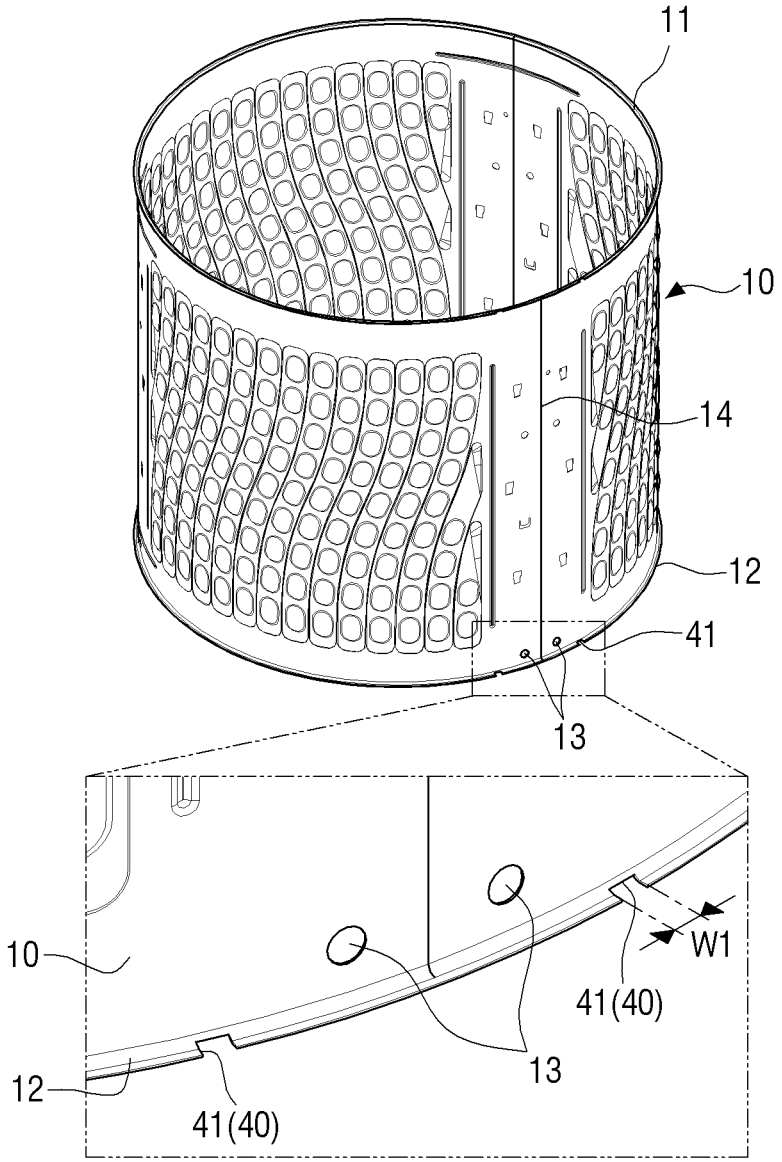
FIG. 3 is a perspective view illustrating a drum of the washing machine drum assembly according to an embodiment of the disclosure.
Figure 4A:
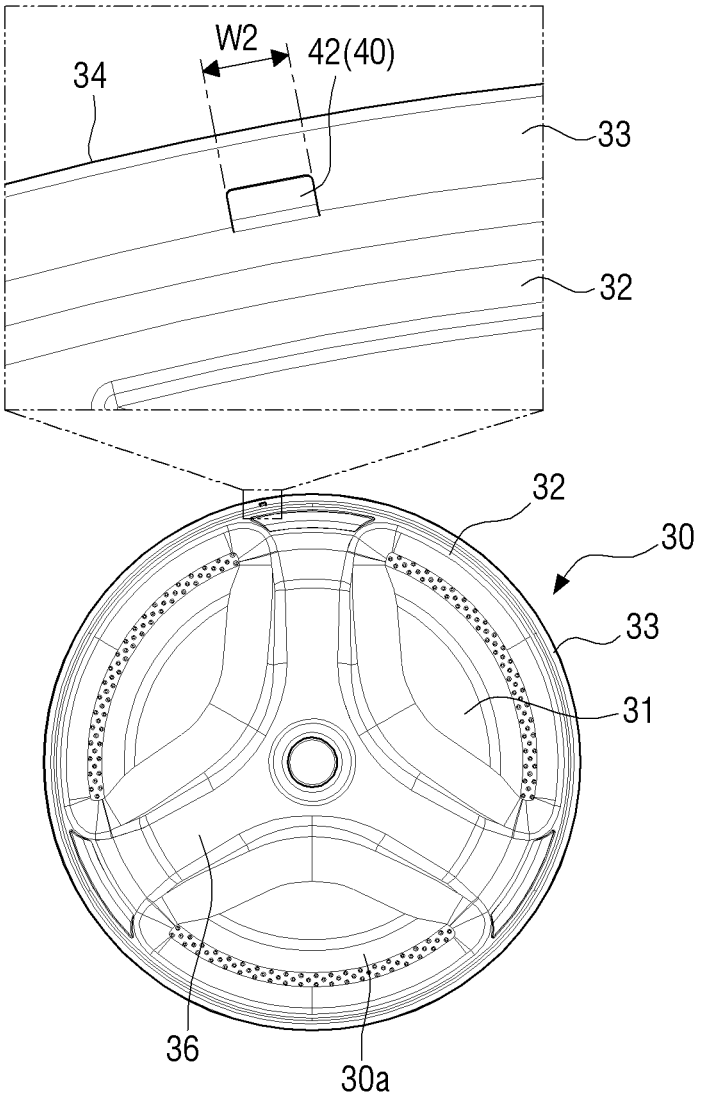
FIG. 4A is a perspective view illustrating a rear surface plate of the washing machine drum assembly according to an embodiment of the disclosure.
Figure 4B:
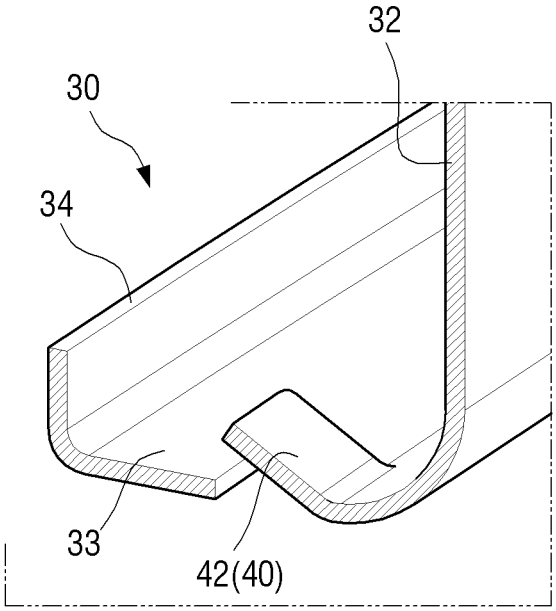
FIG. 4B is a partial cross-sectional view of the rear surface plate of FIG. 4A taken along line I-I.
Figure 5A:
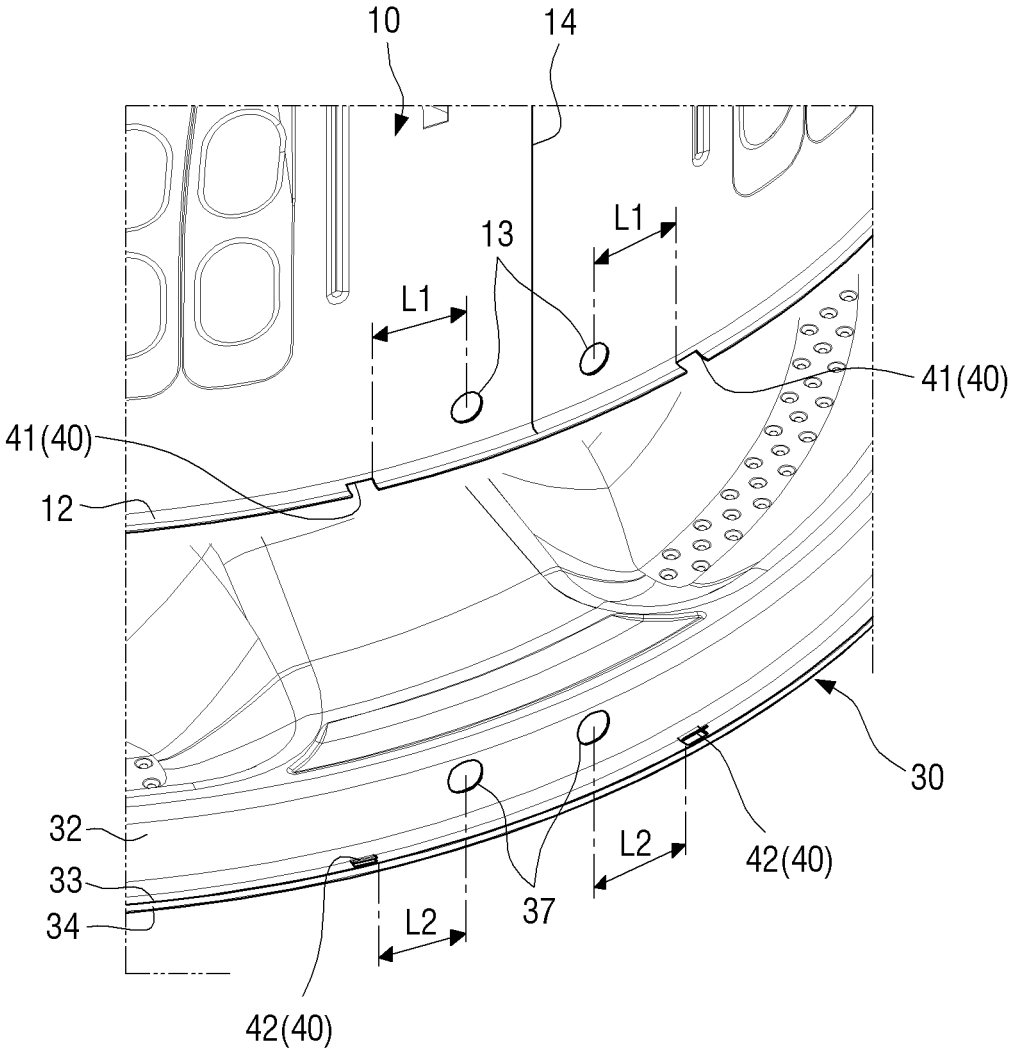
FIG. 5A is a partial perspective view illustrating a state before protrusions of the rear surface plate are inserted into notches of the drum of the washing machine drum assembly according to an embodiment of the disclosure.
Figure 5B:
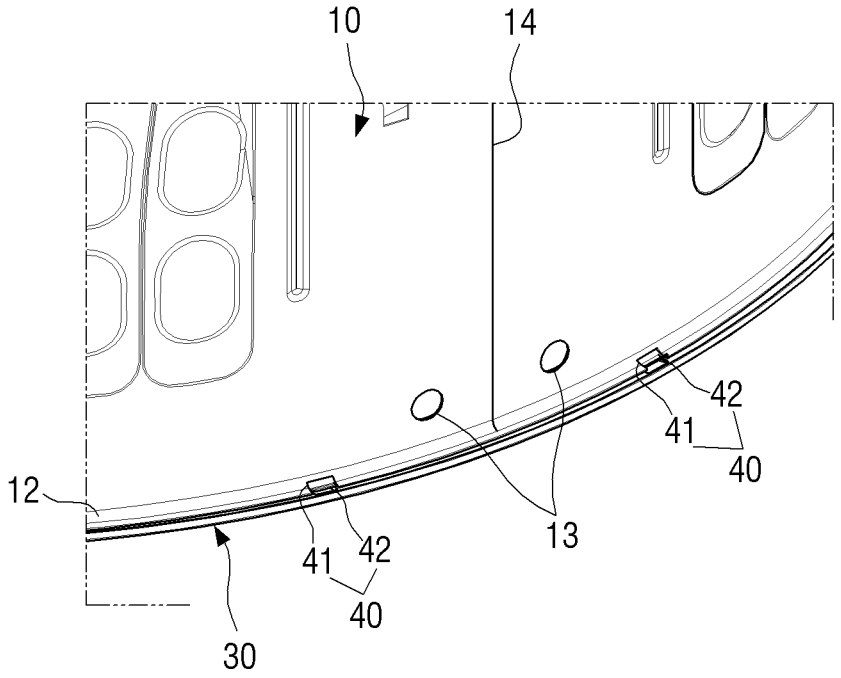
FIG. 5B is a partial perspective view illustrating a state in which the protrusions of the rear surface plate are inserted into the notches of the drum of the washing machine drum assembly according to an embodiment of the disclosure.

FIG. 1 is a perspective view illustrating a washing machine drum assembly according to an embodiment of the disclosure, and FIG. 2 is an exploded perspective view of the washing machine drum assembly of FIG. 1. FIG. 3 is a perspective view illustrating a drum of the washing machine drum assembly according to an embodiment of the disclosure. FIG. 4A is a perspective view illustrating a rear surface plate of the washing machine drum assembly according to an embodiment of the disclosure. FIG. 4B is a partial cross-sectional view of the rear surface plate of FIG. 4A taken along line I-I. FIG. 5A is a partial perspective view illustrating a state before a protrusion of the rear surface plate is inserted into a notch of the drum of the washing machine drum assembly according to an embodiment of the disclosure, and FIG. 5B is a partial perspective view illustrating a state in which the protrusion of the rear surface plate is inserted into the notch of the drum of the washing machine drum assembly.

Referring to FIGS. 1 and 2, a washing machine drum assembly 1 according to an embodiment of the disclosure may include a drum 10, a front surface plate 20, a rear surface plate 30, and a rear end positioning mechanism 40.

The drum 10 has a hollow cylindrical shape and a front end and a rear end of the drum 10 are open. The drum 10 includes a front end flange 11 provided at the front end and a rear end flange 12 provided at the rear end. The front end flange 11 may be formed by bending a front end portion of the drum 10 at approximately 90 degrees with respect to a side surface of the drum 10. That is, the front end flange 11 may be formed by L-bending the front end portion of the drum 10 by a predetermined length. The rear end flange 12 may be formed by bending a rear end portion of the drum 10 at approximately 90 degrees with respect to the side surface of the drum 10. That is, the rear end flange 12 may be formed by L-bending the rear end portion of the drum 10 by a predetermined length.

A plurality of coupling holes 13 may be formed in the side surface of the drum 10 to be adjacent to the rear end flange 12. The plurality of coupling holes 13 are formed to fix a flange shaft 70 to be mounted on the rear surface plate 30. Therefore, the plurality of coupling holes 13 are formed to be spaced at predetermined intervals along a circumferential direction of the drum 10 to correspond to the flange shaft 70.

The front surface plate 20 has a ring shape in which an opening 21 is formed at the center, and may be inserted into the front end of the drum 10, that is, into a front opening 15. For example, the front surface plate 20 may include a protruding portion 22 inserted into the front opening 15 of the drum 10 and having a circular opening 21, an edge 23 extending along an outer circumferential surface of the protruding portion 22 and having a shape corresponding to the front end flange 11 of the drum 10, and a seaming portion 24 vertically extending from the edge 23. The front surface plate 20 is fixed to the front end flange 11 of the drum 10 in a manner in which the protruding portion 22 of the front surface plate 20 is inserted into the front opening 15 of the drum 10 to allow the edge 23 of the front surface plate 20 to be in contact with the front end flange 11 of the drum 10, and then the seaming portion 24 of the front surface plate 20 is seamed to the front end flange 11 of the drum 10.

The rear surface plate 30 may be inserted into a rear end of the drum 10, that is, into a rear opening. The rear surface plate 30 may cover the rear opening of the drum 10. For example, the rear surface plate 30 may include a central portion 31 having a disc shape to cover the rear opening of the drum 10, an edge 33 extending along an outer circumferential surface of the central portion 31 and having a shape corresponding to the rear end flange 12 of the drum 10, and a seaming portion 34 vertically extending from the edge 33.

A flange groove 35 (see FIG. 19H) in which the flange shaft 70 is mounted is formed at the central portion 31 of a rear surface 30*b* of the rear surface plate 30. Here, a front surface 30*a* of the rear surface plate 30 refers to a surface facing the inside of the drum 10, and the rear surface 30*b* of the rear surface plate 30 refers to a surface facing the outside of the drum 10. A protruding portion 36 forming the flange groove 35 is formed on a front surface of the central portion 31 of the rear surface plate 30. Further, a circular wall 32 is formed on the rear surface 30*b* of the rear surface plate 30 along a circumference of the central portion 31. The circular wall 32 has an outer diameter corresponding to an inner diameter of the rear end of the drum 10. A plurality of rear surface holes 37 for fixing the flange shaft 70 are formed in the circular wall 32 connected to the flange groove 35.

The rear surface plate 30 is fixed to the rear end flange 12 of the drum 10 in a manner in which the circular wall 32 of the rear surface plate 30 is inserted into the rear opening to allow the edge 33 of the rear surface plate 30 to be in contact with the rear end flange 12 of the drum 10, and then the seaming portion 34 of the rear surface plate 30 is seamed to the rear end flange 12 of the drum 10.

The flange shaft 70 (see FIG. 19H) is used to transfer power of a driving motor (not illustrated) of the washing machine, and may include a flange 71 fixed to the rear surface plate 30, and a shaft 75 vertically mounted on a central portion 72 of the flange 71. The flange 71 includes three leg portions 73 extending outward from the central portion 72 on which the shaft 75 is mounted. The three leg portions 73 of the flange 71 may be formed at intervals of 120 degrees around the central portion 72. The three leg portions 73 of the flange 71 each have a length corresponding to an inner diameter of the circular wall 32 of the rear surface plate 30.

The flange groove 35 (see FIG. 19H) of the rear surface plate 30 has a shape corresponding to the central portion 72 and the three leg portions 73 of the flange 71. A plurality of fastening holes 74 are formed in one end of each of the three leg portions 73 of the flange 71, the one end coming into contact with the circular wall 32 of the rear surface plate 30 in case that the flange 71 is fitted into the flange groove 35 of the rear surface plate 30. According to the embodiment, two fastening holes 74 are formed in one leg portion 73 of the flange 71. Therefore, six fastening holes 74 are formed in the flange shaft 70. Here, the fastening hole 74 may be a female screw hole to which a bolt or a screw may be fastened.

Six rear surface holes 37 corresponding to the six fastening holes 74 formed in the three leg portions 73 of the flange 71 are formed in a side surface of the circular wall 32 of the rear surface plate 30 on which the flange shaft 70 is mounted. Here, two rear surface holes 73 corresponding to the two fastening holes 74 of one leg portion 73 of the flange 71 are formed adjacent to each other. The two adjacent rear surface holes 37 are spaced apart from other two adjacent rear surface holes 37 at an interval corresponding to the leg portion 73 in the circumferential direction.

Further, six coupling holes 13 are formed at the rear end of the drum 10 to which the rear surface plate 30 is coupled, that is, in the vicinity of the rear end flange 12 of the drum 10, to correspond to the six rear surface holes 37 of the rear surface plate 30.

As the rear surface plate 30 is mounted on the rear end of the drum 10 while allowing the six rear surface holes 37 of the rear surface plate 30 and the six coupling holes 13 of the rear end portion of the drum 10 to be aligned with each other, and the flange shaft 70 is mounted on the rear surface plate 30 while allowing the six rear surface holes 37 of the rear surface plate 30 and the six fastening holes 74 of the flange shaft 70 to be aligned with each other, the flange shaft 70 may be fixed to the rear surface plate 30 of the drum 10 by using six fastening elements 77, that is, six bolts or six screws.

The rear end positioning mechanism 40 is provided to position the rear surface plate 30 to allow the six rear surface holes 37 of the rear surface plate 30 to be aligned with the six coupling holes 13 formed in the rear end portion of the drum 10 at the time of inserting the rear surface plate 30 into the rear opening of the drum 10. The rear end positioning mechanism 40 may be formed in the rear end flange 12 of the drum 10 and the rear surface plate 30.

For example, the rear end positioning mechanism 40 may include two notches 41 formed in the rear end flange 12 of the drum 10, and two protrusions 42 formed in the rear surface plate 30 and inserted into the two notches 41, respectively.

The two notches 41 formed in the rear end flange 12 of the drum 10 have a predetermined positional relationship with the plurality of coupling holes 13 formed in the rear end portion of the drum 10, and the two protrusions 42 formed in the rear surface plate 30 have a predetermined positional relationship with the plurality of rear surface holes 37. Specifically, the positional relationship between the two protrusions 42 and the plurality of rear surface holes 37 formed in the rear surface plate 30 is the same as the positional relationship between the two notches 41 and the plurality of coupling holes 13 formed in the drum 10. Therefore, as the rear surface plate 30 is inserted into the rear opening of the drum 10 while allowing the two protrusions 42 of the rear surface plate 30 to be inserted into the two notches 41 of the rear end flange 12 of the drum 10, the plurality of rear surface holes 37 of the rear surface plate 30 and the plurality of coupling holes 13 of the drum 10 are aligned with each other.

Further, as the two protrusions 42 of the rear surface plate 30 are inserted into the two notches 41 of the drum 10, respectively, it is possible to prevent the rear surface plate 30 from slipping or rotating with respect to the rear end flange 12 of the drum 10.

As illustrated in FIG. 3, the two notches 41 may each be a rectangular groove formed in an edge of the rear end flange 12 of the drum 10. Further, the two notches 41 are formed to be spaced apart from each other by a predetermined distance in the circumferential direction in the rear end flange 12 of the drum 10. Here, the two notches 41 are formed to be spaced apart from the two coupling holes 13 formed in the rear end portion of the drum 10 by a predetermined distance. For example, in case that the two coupling holes 13 are line symmetric with respect to a weld line 14 formed in the side surface of the drum 10 as illustrated in FIG. 3, the two notches 41 formed in the rear end flange 12 are also line symmetric with respect to the weld line 14 of the drum 10.

The two protrusions 42 of the rear surface plate 30 may each have a rectangular shape having a width W2 corresponding to a width W1 of each of the two notches 41 of the rear end flange 12 of the drum 10. Further, the two protrusions 42 may be formed to be spaced apart from each other by a predetermined distance in the circumferential direction, in the rear surface plate 30. Here, a distance L2 (see FIG. 5A) between the protrusion 42 of the rear surface plate 30 and the rear surface hole 37 may be the same as a distance L1 (see FIG. 5A) between the notch 41 of the drum 10 and the coupling hole 13.

For example, the two protrusions 42 are formed in the edge 33 of the rear surface plate 30 as illustrated in FIG. 4A. The two protrusions 42 may each be formed by cutting a portion of the edge 33 of the rear surface plate 30 in a "U"-letter shape with a flat bottom, that is, in a rectangular shape having one side surface connected to the edge 33, and bending the cut portion at a predetermined angle as illustrated in FIG. 4B. Here, the width W2 of the cut portion having the rectangular shape, that is, the width W2 of the protrusion 42, may be suitable for insertion into the notch 41, and corresponds to the width W1 of the notch 41 to maintain the positional relationship between the rear surface holes 37 of the rear surface plate 30 and the coupling holes 13 of the drum 10.

As such, in case that two notches 41 are formed in the rear end flange 12 of the drum 10, and two protrusions 42 corresponding to the two notches 41 are formed in the rear surface plate 30, the two protrusions 42 of the rear surface plate 30 may be inserted into and coupled to the two notches 41 of the rear end flange 12 of the drum 10. Specifically, the rear surface plate 30 is positioned to allow the two protrusions 42 to be aligned with the two notches 41 of the rear end flange 12 of the drum 10 and then the rear surface plate 30 is inserted to be in contact with the rear end flange 12 of the drum 10 as illustrated in FIG. 5A. Then, the two protrusions 42 of the rear surface plate 30 are inserted into the two notches 41 of the rear end flange 12 of the drum 10, respectively, as illustrated in FIG. 5B. As such, as the protrusions 42 of the rear surface plate 30 are inserted into the notches 41 of the drum 10, respectively, the plurality of rear surface holes 37 of the rear surface plate 30 and the plurality of coupling holes 13 of the drum 10 are aligned with each other.

Although the case that the two notches 41 of the drum 10 are formed on opposite sides of the two coupling holes 13 has been described above, the positions of the notches 41 are not limited thereto. The two notches 41 may be formed at various positions as long as positioning of the rear surface plate 30 with respect to the drum 10 may be performed at the time of coupling.

Another example of the notch 41 formed in the drum 10 and the protrusion 42 formed in the rear surface plate 30 will be described with reference to FIGS. 6A and 6B.

Figure 6A:
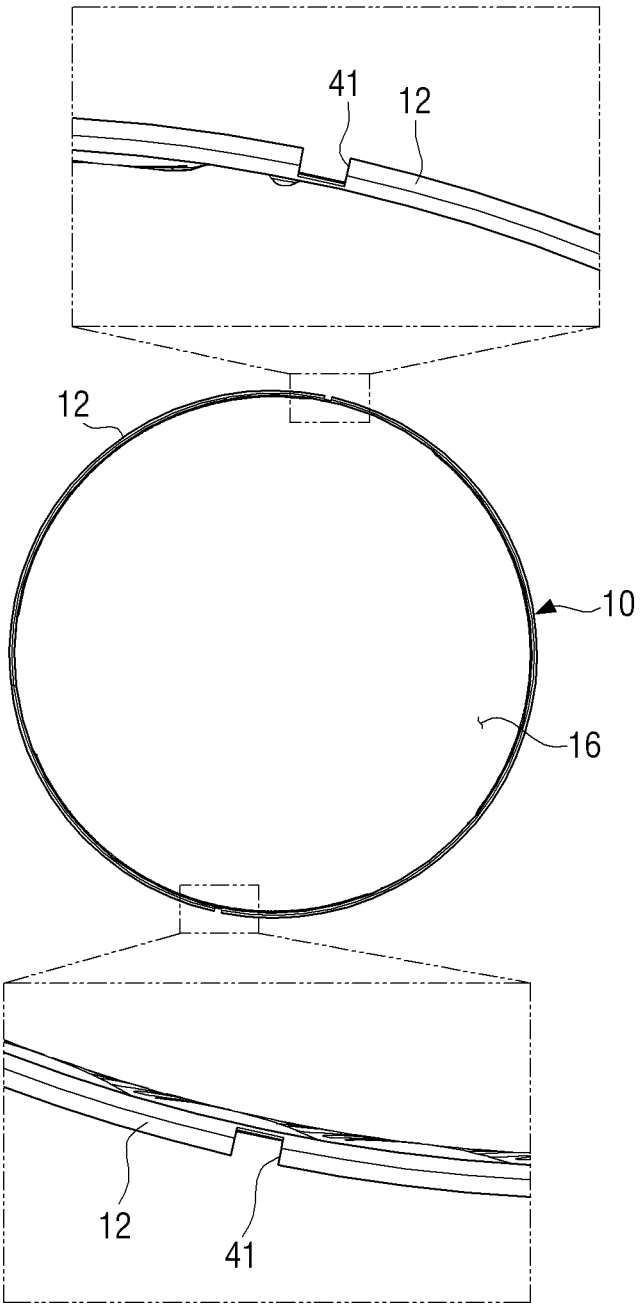
FIG. 6A is a view illustrating another example of the notch of the drum of the washing machine drum assembly according to an embodiment of the disclosure.
Figure 6B:
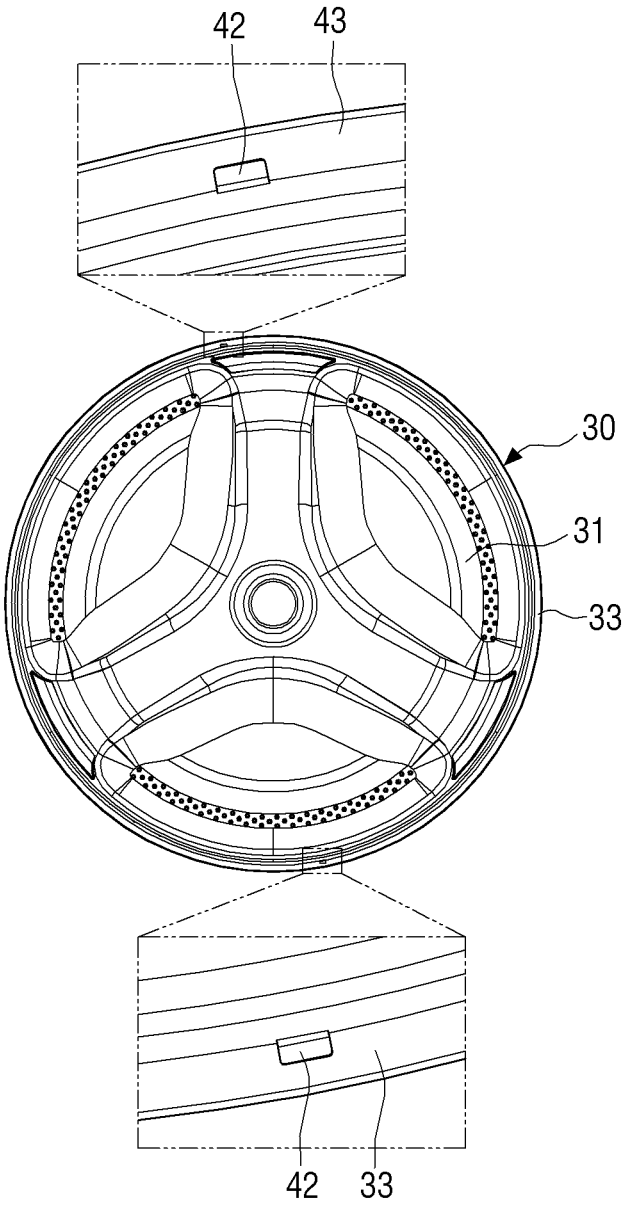
FIG. 6B is a view illustrating a protrusion of the rear surface plate that is coupled to the notch of the drum of the washing machine drum assembly of FIG. 6A.

FIG. 6A is a view illustrating another example of the notch of the drum of the washing machine drum assembly according to an embodiment of the disclosure, and FIG. 6B is a view illustrating a protrusion of the rear surface plate that is coupled to the notch of the drum of the washing machine drum assembly of FIG. 6A.

Referring to FIG. 6A, two notches 41 may be formed to be spaced at an interval of approximately 180 degrees around the center of the drum 10, in the rear end flange 12 of the drum 10. Here, two protrusions 42 formed in the rear surface plate 30 are formed at positions corresponding to the two notches 41 of the drum 10, respectively. That is, the two protrusions 42 may be formed to be spaced at an interval of approximately 180 degrees around the center of the rear surface plate 30, in the edge 33 of the rear surface plate 30 as illustrated in FIG. 6B.

Figure 7:
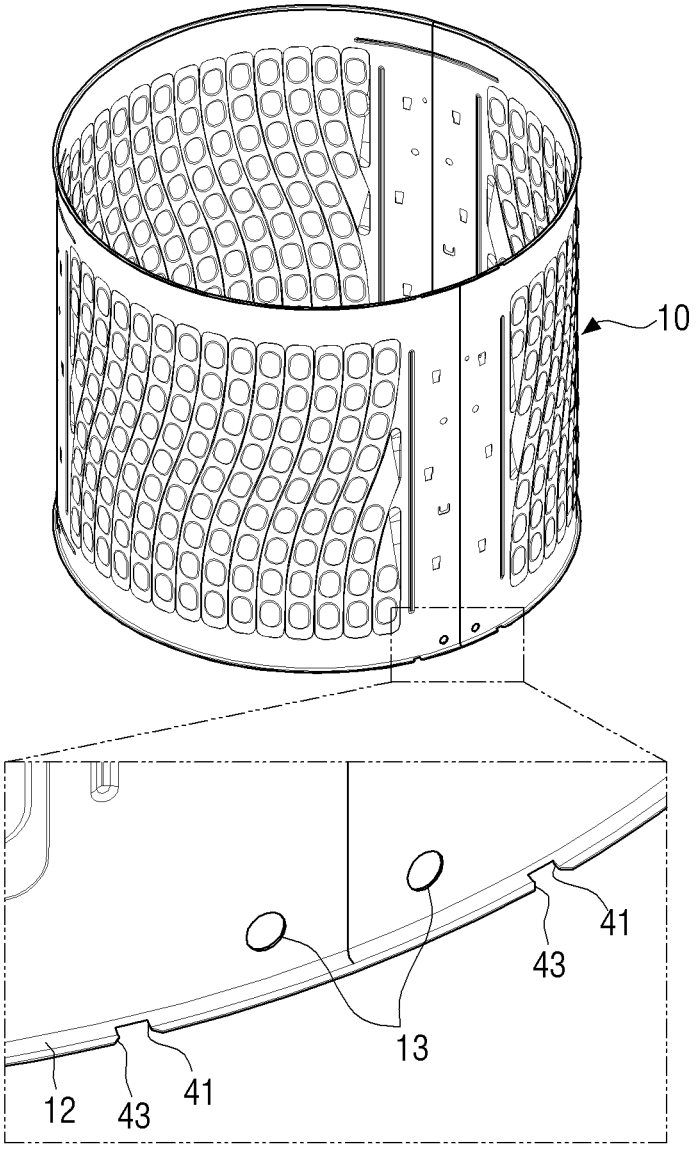
FIG. 7 is a partial perspective view illustrating another example of the notch of the drum of the washing machine drum assembly according to an embodiment of the disclosure.

Further, a chamfer 43 may be formed at an inlet portion of the notch 41 formed in the drum 10 as illustrated in FIG. 7. In case that the chamfer 43 is formed in the notch 41 as described above, the protrusion 42 of the rear surface plate 30 may be easily inserted into the notch 41 of the drum 10 at the time of inserting the rear surface plate 30 into the rear opening 16 of the drum 10. FIG. 7 is a partial perspective view illustrating the case that the chamfer is formed in the notch of the drum of the washing machine drum assembly according to an embodiment of the disclosure.

Although the case that the rear end positioning mechanism 40 is configured with the notch 41 formed in the rear end flange 12 of the drum 10 and the protrusion 42 formed in the rear surface plate 30 has been described above, but the rear end positioning mechanism 40 is not limited thereto. The rear end positioning mechanism 40 may also have a structure that is reverse to that described above. Hereinafter, the rear end positioning mechanism 40 having the reverse structure will be described with reference to FIGS. 8 and 9.

Figure 8:
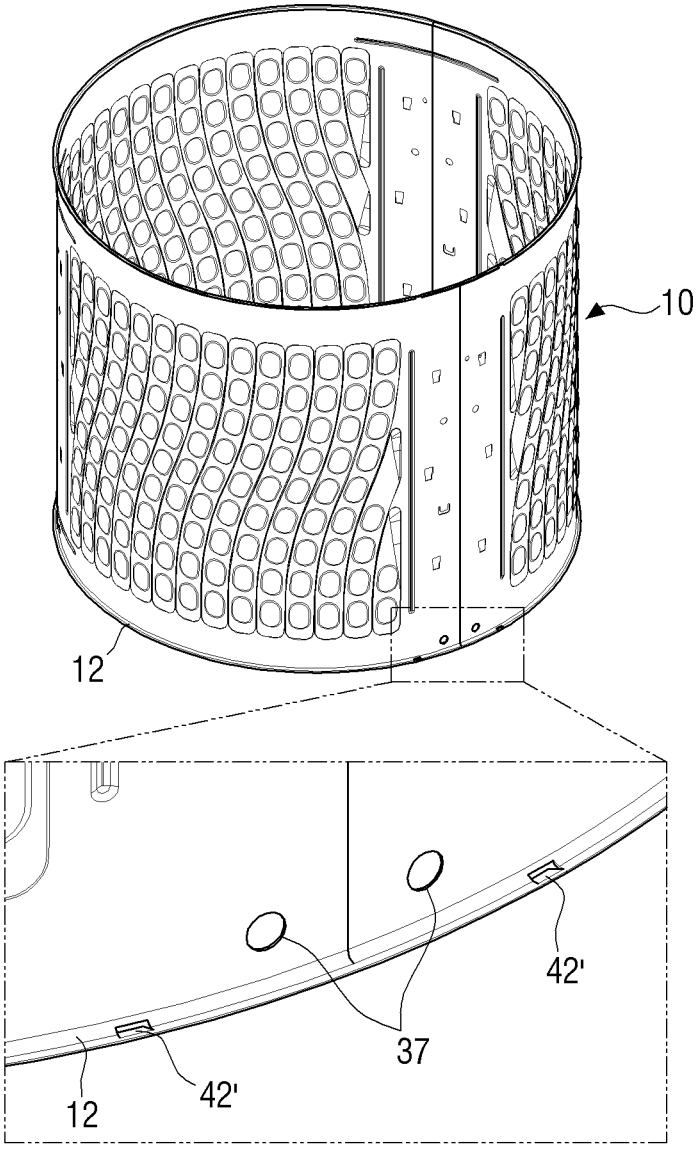
FIG. 8 is a perspective view illustrating the drum of the washing machine drum assembly according to an embodiment of the disclosure.
Figure 9:
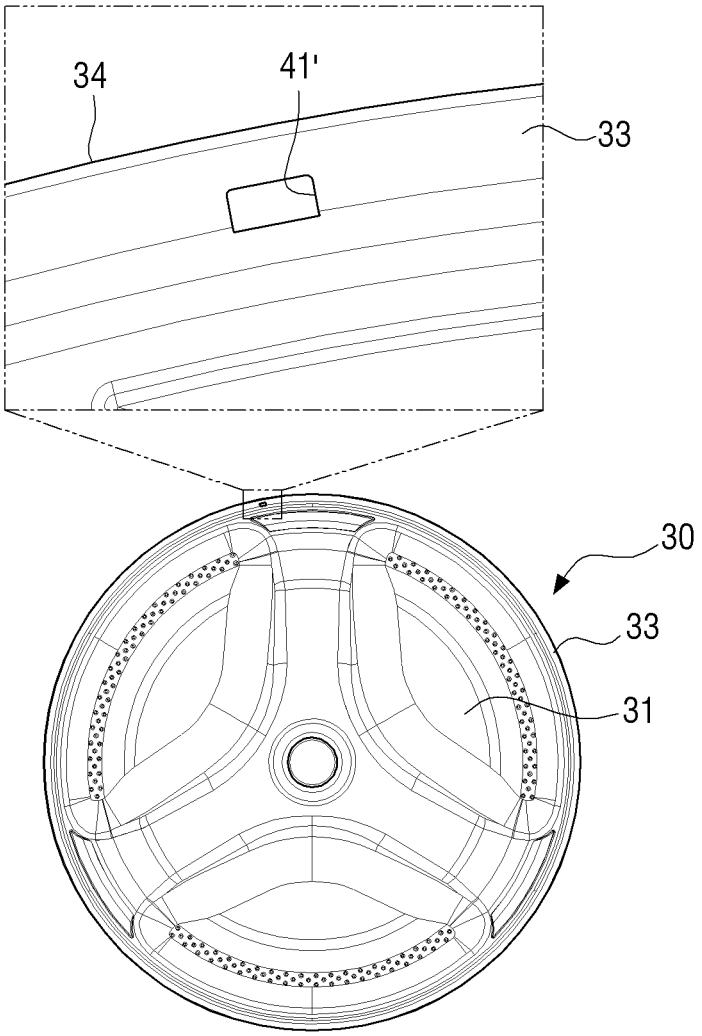
FIG. 9 is a perspective view illustrating the rear surface plate coupled to the drum of the washing machine drum assembly of FIG. 8.

FIG. 8 is a perspective view illustrating the drum of the washing machine drum assembly according to an embodiment of the disclosure, and FIG. 9 is a perspective view illustrating the rear surface plate coupled to the drum of the washing machine drum assembly of FIG. 8.

The rear end positioning mechanism 40 of the washing machine drum assembly 1 according to the embodiment includes two protrusions 42' formed in the rear end flange 12 of the drum 10 and two notches 41' formed in the rear surface plate 30.

Referring to FIG. 8, the two protrusions 42' are formed in the rear end flange 12 of the drum 10 to be able to be coupled to the two notches 41' formed in the rear surface plate 30. The two protrusions 42' are formed to be spaced apart from each other by a predetermined distance in the circumferential direction in the rear end flange 12 of the drum 10.

A shape of each of the two protrusions 42' formed in the drum 10 is similar to that of the protrusion 42 formed in the rear surface plate 30 of the rear end positioning mechanism 40 according to the embodiment described above, and thus a detailed description thereof is omitted. Further, positions of the two protrusions 42' are the same as those of the two notches 41 of the rear end positioning mechanism 40 according to the embodiment described above that are formed in the rear end flange 12 of the drum 10, and thus a detailed description thereof is omitted. The two protrusions 42' of the rear end flange 12 of the drum 10 have a predetermined positional relationship with the plurality of coupling holes 13 of the drum 10.

Referring to FIG. 9, the two notches 41' are formed in the rear surface plate 30 to allow the two protrusions 42' to be inserted thereinto, the two protrusions 42' being formed in the rear end flange 12 of the drum 10. The two notches 41' are formed to be spaced apart from each other by a predetermined distance in the circumferential direction in the edge 33 of the rear surface plate 30.

The two notches 41' may each be a rectangular through-hole formed in the edge 33 of the rear surface plate 30. Further, positions of the two notches 41' are the same as those of the two protrusions 42 of the rear end positioning mechanism 40 according to the embodiment described above that are formed in the rear surface plate 30, and thus a detailed description thereof is omitted. Accordingly, a positional relationship between the two notches 41' and the plurality of rear surface holes 37 of the rear surface plate 30 is the same as the positional relationship between the two protrusions 42' and the plurality of coupling holes 13 of the drum 10.

Therefore, once the rear surface plate 30 is inserted into the rear opening 16 of the drum 10 in a state in which the two notches 41' of the rear surface plate 30 are aligned with the two protrusions 42' of the drum 10, the two protrusions 42' of the drum 10 are inserted into the two notches 41' of the rear surface plate 30. As a result, it is possible to prevent the rear surface plate 30 from slipping or rotating with respect to the drum 10 in the circumferential direction. Further, the plurality of rear surface holes 37 of the rear surface plate 30 and the plurality of coupling holes 13 of the drum 10 are aligned with each other.

Although the case that the rear end positioning mechanism 40 includes two notches 41 or 41' and two protrusions 42 or 42' has been described above, the numbers of notches 41 or 41' and protrusions 42 or 42' configuring the rear end positioning mechanism 40 are not limited thereto. The rear end positioning mechanism 40 is used to prevent rotation of the rear surface plate 30 with respect to the drum 10 and determine a position where the rear surface plate 30 is inserted, and thus the numbers of notches 41 or 41' and protrusions 42 or 42' configuring the rear end positioning mechanism 40 may each be one. In other words, the numbers of notches 41 or 41' and protrusions 42 or 42' configuring the rear end positioning mechanism 40 may each be at least one.

Although the case that the rear end positioning mechanism 40 includes the notches 41 or 41' and the protrusions 42 or 42' has been described above, the structure of the rear end positioning mechanism 40 is not limited thereto. Hereinafter, another example of the rear end positioning mechanism will be described with reference to FIGS. 10A to 11B.

Figure 10A:
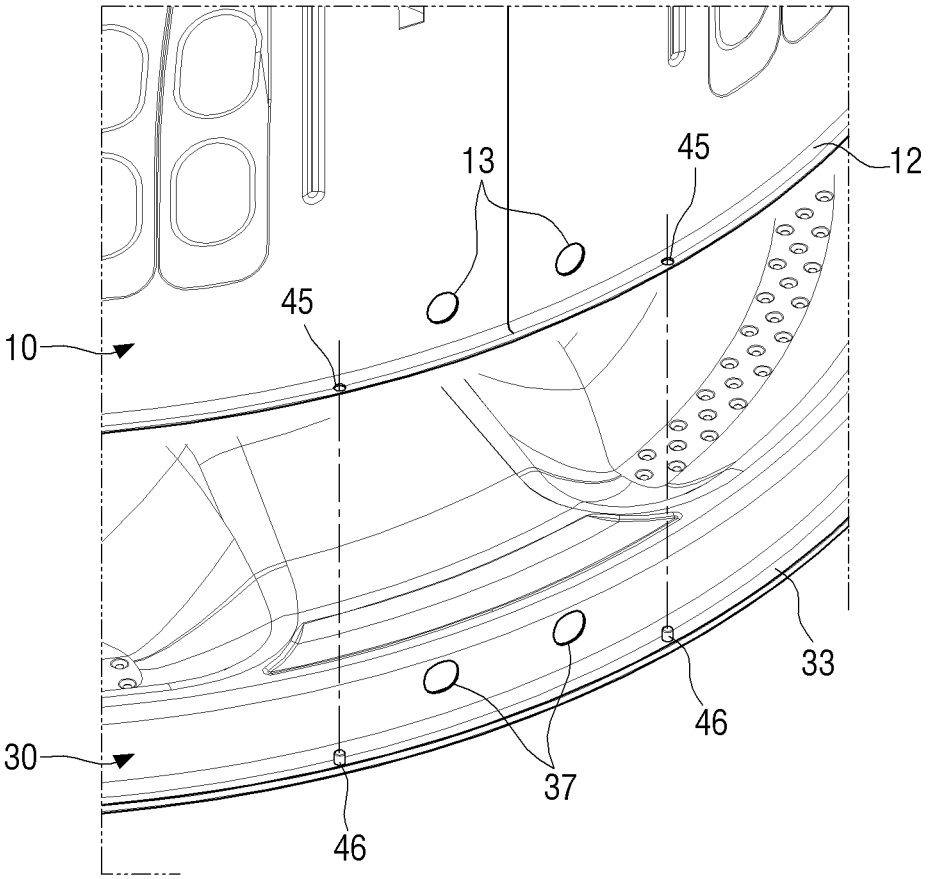
FIG. 10A is a partial perspective view illustrating a hole formed in the drum and a protrusion formed on the rear surface plate as another example of a rear end positioning mechanism of the washing machine drum assembly according to an embodiment of the disclosure.
Figure 10B:
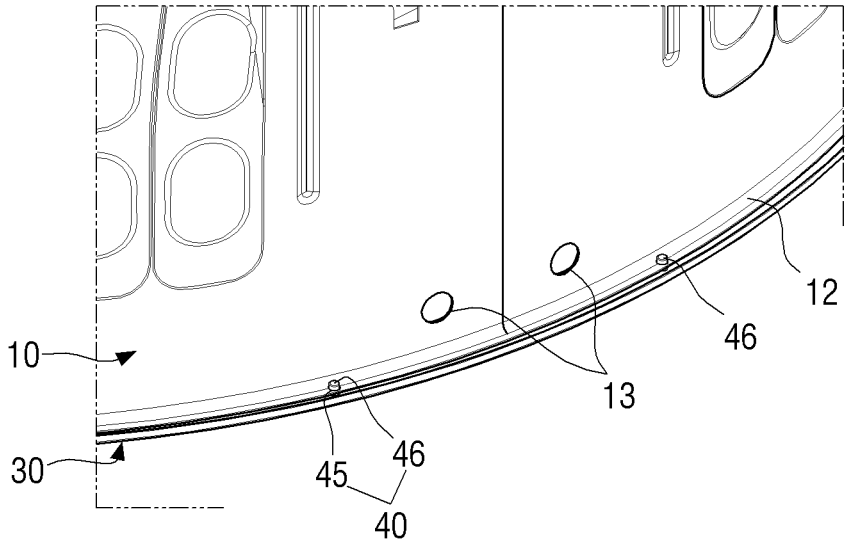
FIG. 10B is a partial perspective view illustrating a state in which the protrusion of the rear surface plate is inserted into the hole of the drum of the washing machine drum assembly of FIG. 10A.

FIG. 10A is a partial perspective view illustrating a hole formed in the drum and a protrusion formed on the rear surface plate as another example of the rear end positioning mechanism of the washing machine drum assembly according to an embodiment of the disclosure, and FIG. 10B is a partial perspective view illustrating a state in which the protrusion of the rear surface plate is inserted into the hole of the drum of the washing machine drum assembly of FIG. 10A.

Referring to FIG. 10A, the rear end positioning mechanism 40 includes a hole 45 formed in the rear end flange 12 of the drum 10, and a circular protrusion 46 formed on the rear surface plate 30. The hole 45 formed in the rear end flange 12 is a circular hole into which the circular protrusion 46 of the rear surface plate 30 may be inserted.

Therefore, once the rear surface plate 30 is inserted into the rear opening of the drum 10 in a state in which the hole 45 of the rear end flange 12 and the circular protrusion 46 of the rear surface plate 30 are aligned with each other, the circular protrusion 46 of the rear surface plate 30 is fixed in a state of being inserted into the hole 45 of the drum 10 as illustrated in FIG. 10B.

As such, the rear end positioning mechanism 40 configured with the hole 45 and the circular protrusion 46 may allow the plurality of rear surface holes 37 of the coupled rear surface plate 30 and the plurality of coupling holes 13 of the drum 10 to be aligned with each other, and may prevent the rear surface plate 30 from slipping or rotating with respect to the drum 10 in the circumferential direction.

Figure 11A:
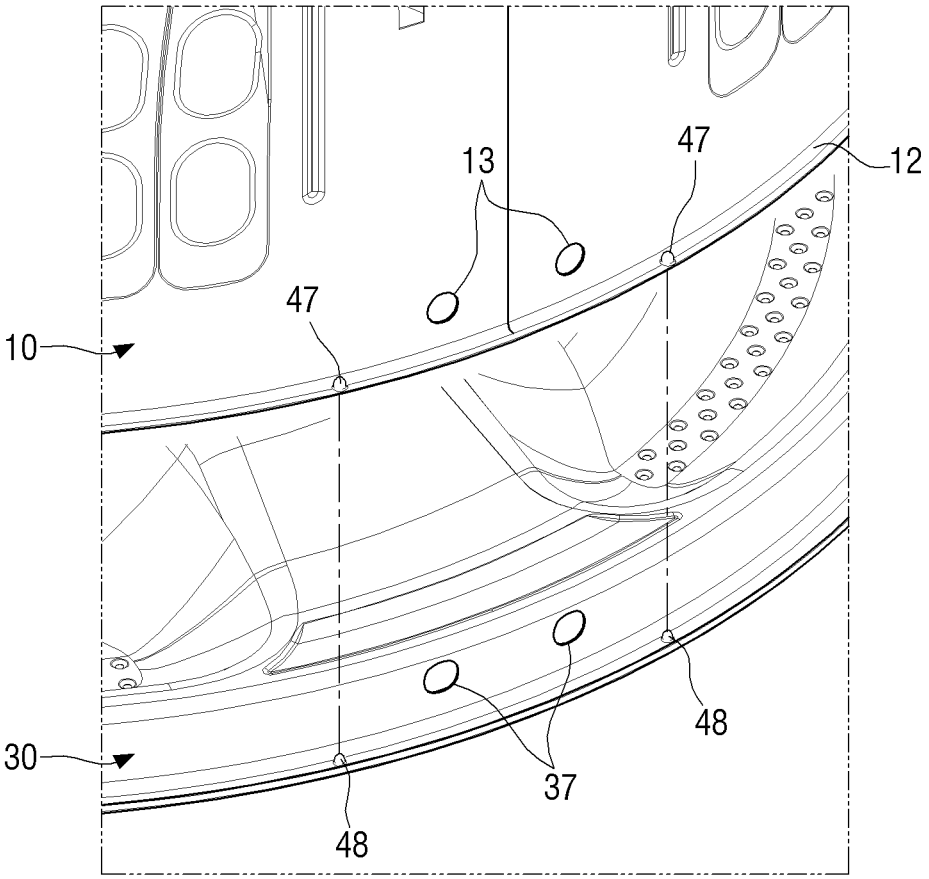
FIG. 11A is a partial perspective view illustrating a female protrusion formed on the drum and a male protrusion formed on the rear surface plate as another example of the rear end positioning mechanism of the washing machine drum assembly according to an embodiment of the disclosure.
Figure 11B:
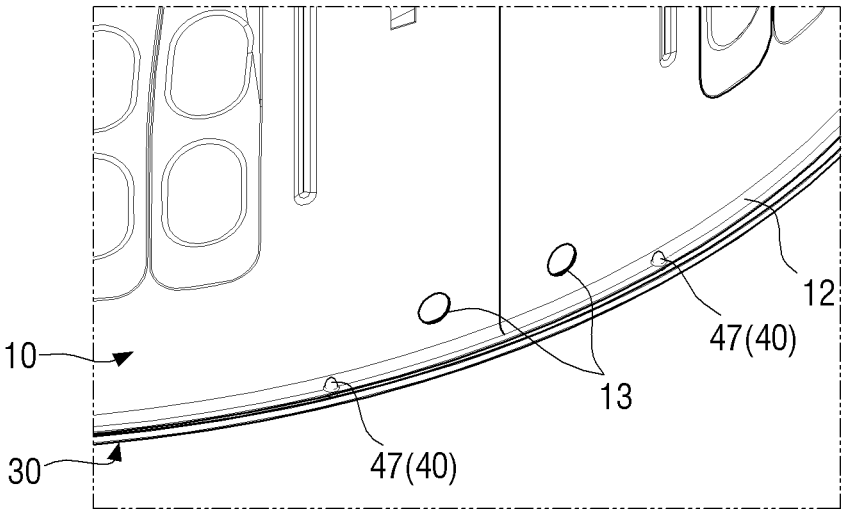
FIG. 11B is a partial perspective view illustrating a state in which the male protrusion of the rear surface plate is inserted into the female protrusion of the drum of the washing machine drum assembly of FIG. 11A.

FIG. 11A is a partial perspective view illustrating a female protrusion formed on the drum and a male protrusion formed on the rear surface plate as another example of the rear end positioning mechanism of the washing machine drum assembly according to an embodiment of the disclosure, and FIG. 11B is a partial perspective view illustrating a state in which the male protrusion of the rear surface plate is inserted into the female protrusion of the drum of the washing machine drum assembly of FIG. 11A.

Referring to FIG. 11A, the rear end positioning mechanism 40 includes a female protrusion 47 formed on the rear end flange 12 of the drum 10, and a male protrusion 48 formed on the rear surface plate 30. A concave groove is formed in one surface of the female protrusion 47 facing the rear surface plate 30. The male protrusion 48 of the rear surface plate 30 may be inserted into the concave groove of the female protrusion 47 of the rear surface plate 30. The female protrusion 47 and the male protrusion 48 may have various shapes such as a hemispherical shape, a dome shape, a cone shape, and the like.

Therefore, once the rear surface plate 30 is inserted into the rear opening 16 of the drum 10 in a state in which the female protrusion 47 of the rear end flange 12 and the male protrusion 48 of the rear surface plate 30 are aligned with each other, the male protrusion 48 of the rear surface plate 30 is fixed in a state of being inserted into the female protrusion 47 of the drum 10 as illustrated in FIG. 11B.

As such, the rear end positioning mechanism 40 configured with the female protrusion 47 and the male protrusion 48 may allow the plurality of rear surface holes 37 of the coupled rear surface plate 30 and the plurality of coupling holes 13 of the drum 10 to be aligned with each other, and may prevent the rear surface plate 30 from slipping or rotating with respect to the drum 10 in the circumferential direction.

Although the case that the rear end positioning mechanism 40 is provided in the rare end flange 12 of the drum 10 and the rear surface plate 30 has been described above, a front end positioning mechanism 50 may also be provided in the front end flange 11 of the drum 10 and the front surface plate 20.

Hereinafter, a washing machine drum assembly including the front end positioning mechanism according to another embodiment of the disclosure will be described in detail with reference to FIGS. 12 to 14B.

Figure 12:
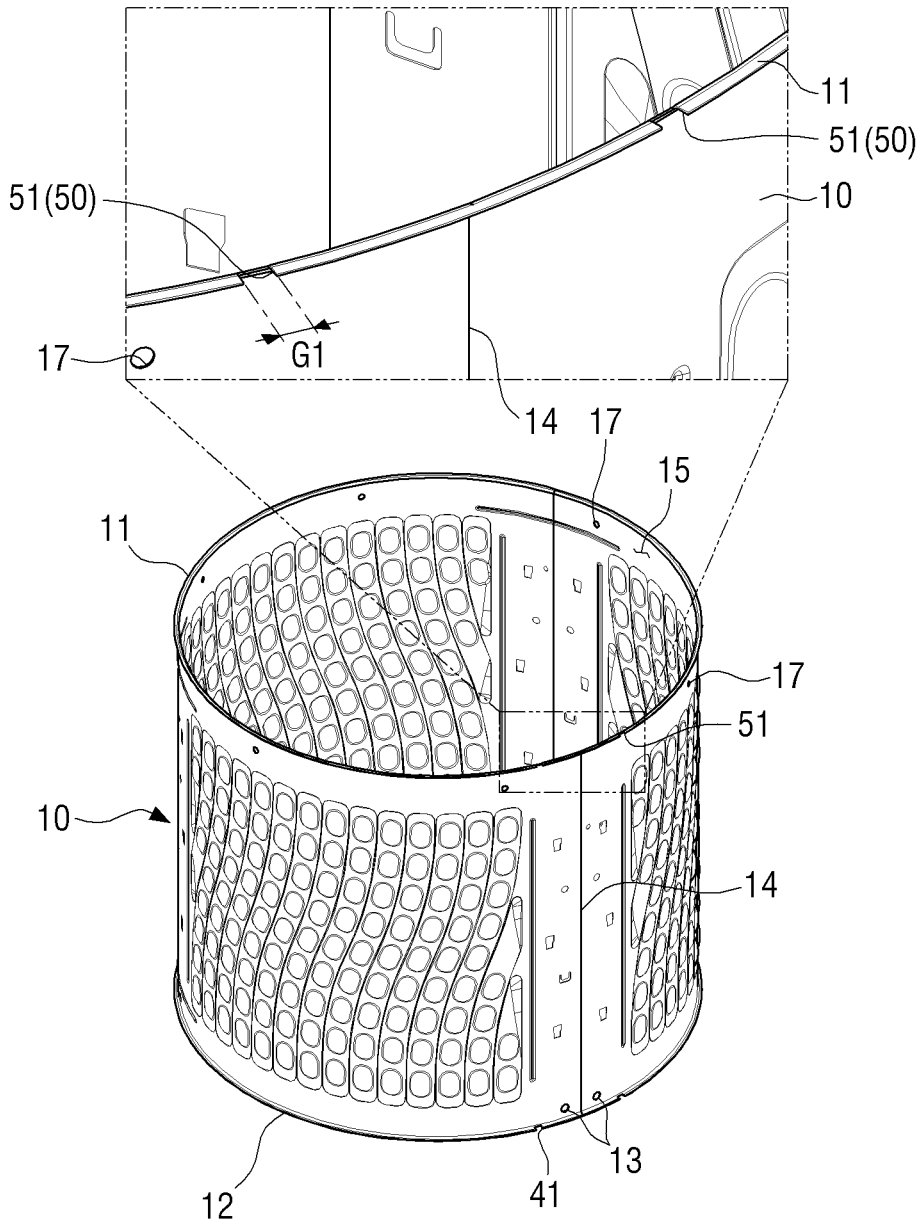
FIG. 12 is a perspective view illustrating a drum of a washing machine drum assembly according to another embodiment of the disclosure.
Figure 13A:
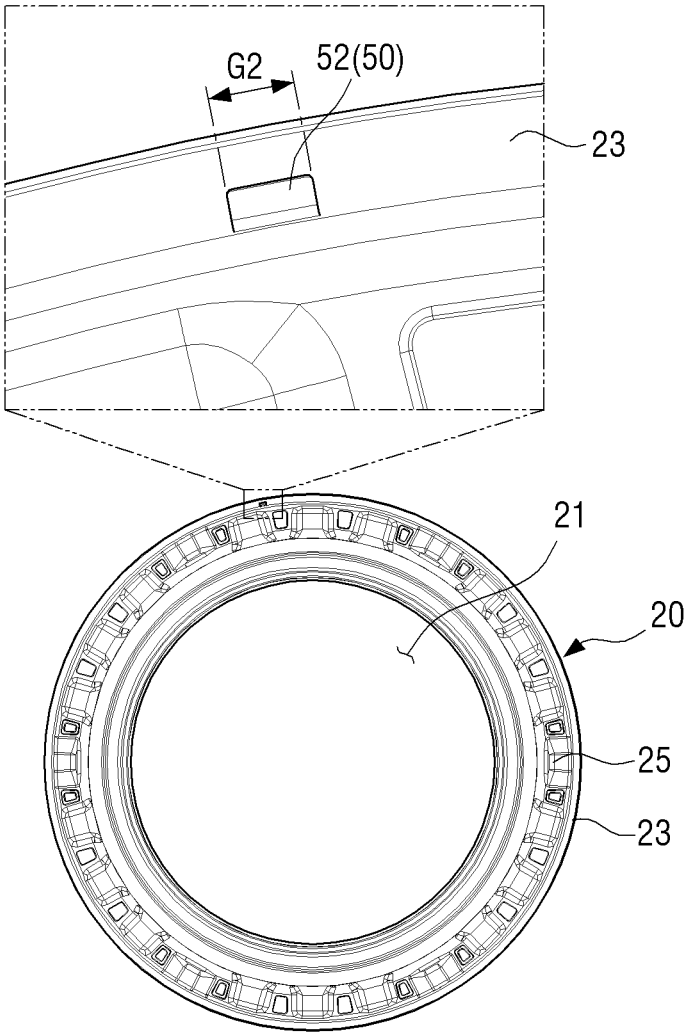
FIG. 13A is a perspective view illustrating a front surface plate of the washing machine drum assembly according to another embodiment of the disclosure.
Figure 13B:
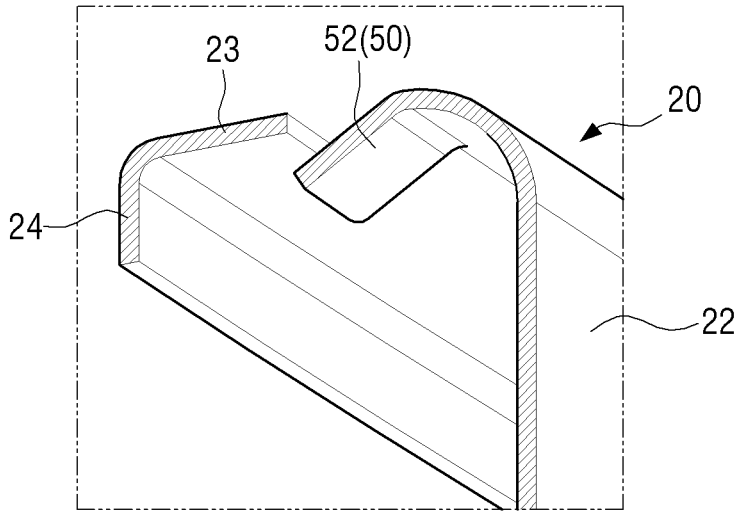
FIG. 13B is a partial cross-sectional view of the front surface plate of FIG. 13A taken along line II-II.
Figure 14A:
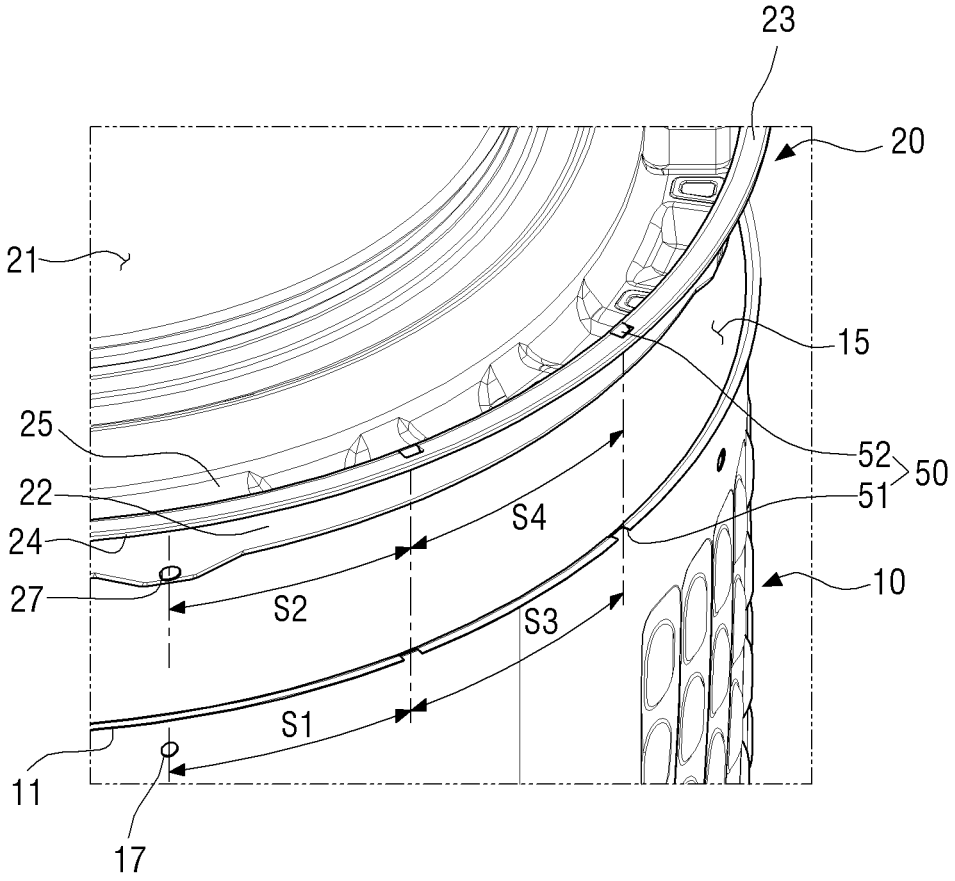
FIG. 14A is a partial perspective view illustrating a state before a protrusion of the front surface plate is inserted into a notch of the drum of the washing machine drum assembly according to another embodiment of the disclosure.
Figure 14B:
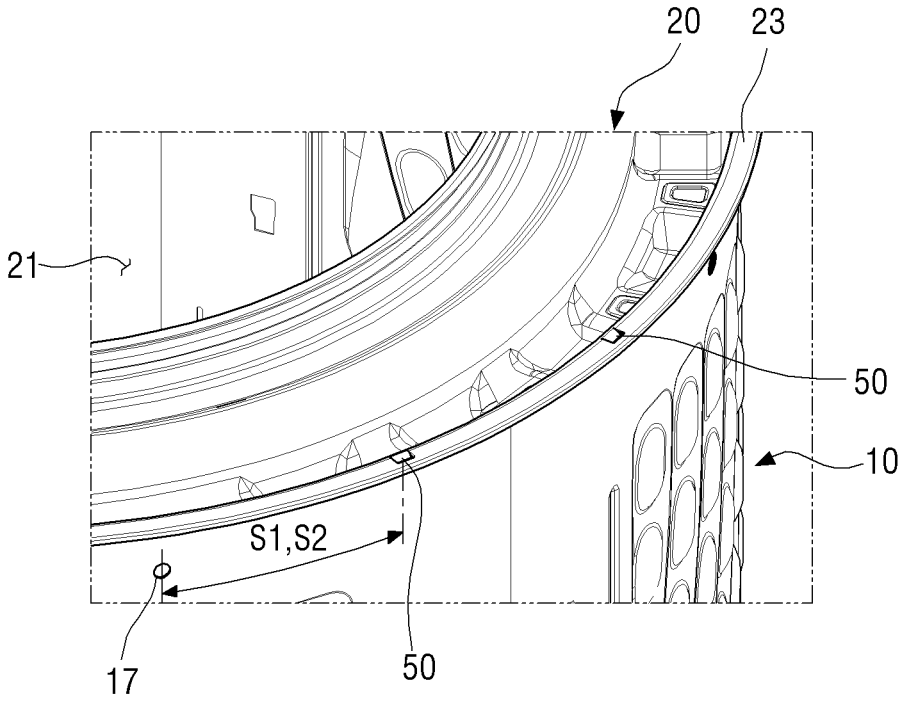
FIG. 14B is a partial perspective view illustrating a state in which the protrusion of the front surface plate is inserted into the notch of the drum of the washing machine drum assembly according to another embodiment of the disclosure.

FIG. 12 is a perspective view illustrating a drum of a washing machine drum assembly according to another embodiment of the disclosure. FIG. 13A is a perspective view illustrating a front surface plate of the washing machine drum assembly according to another embodiment of the disclosure, and FIG. 13B is a partial cross-sectional view of the front surface plate of FIG. 13A taken along line II-II. FIG. 14A is a partial perspective view illustrating a state before a protrusion of the front surface plate is inserted into a notch of the drum of the washing machine drum assembly according to another embodiment of the disclosure, and FIG. 14B is a partial perspective view illustrating a state in which the protrusion of the front surface plate is inserted into the notch of the drum of the washing machine drum assembly according to another embodiment of the disclosure.

Referring to FIG. 12, the drum 10 has a hollow cylindrical shape and a front end and a rear end of the drum 10 are open. The drum 10 includes a front end flange 11 provided at the front end and a rear end flange 12 provided at the rear end. The front end flange 11 may be formed by bending a front end portion of the drum 10 at approximately 90 degrees with respect to a side surface of the drum 10. That is, the front end flange 11 may be formed by L-bending a portion of the front end of the drum 10, the portion corresponding to a predetermined length. The rear end flange 12 may be formed by bending a rear end portion of the drum 10 at approximately 90 degrees with respect to the side surface of the drum 10. That is, the rear end flange 12 may be formed by L-bending a portion of the rear end of the drum 10, the portion corresponding to a predetermined length.

A plurality of front end coupling holes 17 may be formed in the side surface of the drum 10 to be adjacent to the front end flange 11. The plurality of front end coupling holes 17 are formed to be able to fix a ball balancer 60 mounted on the front surface plate 20. Therefore, the plurality of front end coupling holes 17 are formed to be spaced at predetermined intervals along a circumferential direction of the drum 10 to correspond to the ball balancer 60.

Further, a plurality of coupling holes 13 may be formed in the side surface of the drum 10 to be adjacent to the rear end flange 12. The plurality of coupling holes 13 are formed to be able to fix a flange shaft 70 mounted on the rear surface plate 30. Therefore, the plurality of coupling holes 13 are formed to be spaced at predetermined intervals along a circumferential direction of the drum 10 to correspond to the flange shaft 70.

The rear surface plate 30 may be inserted into a rear end of the drum 10, that is, into a rear opening 16. The rear surface plate 30 may cover the rear opening 16 of the drum 10. Such a rear surface plate 30 is the same as the rear surface plate 30 according to the embodiment described above. For example, as illustrated in FIG. 2, the rear surface plate 30 may include a central portion 31 having a disc shape to cover the rear opening of the drum 10, an edge 33 extending along an outer circumferential surface of the central portion 31 and having a shape corresponding to the rear end flange 12 of the drum 10, and a seaming portion 34 vertically extending from the edge 33.

A flange groove 35 (see FIG. 19H) in which the flange shaft 70 is mounted is formed at the central portion 31 of a rear surface 30*b* of the rear surface plate 30. Here, a front surface 30*a* of the rear surface plate 30 refers to a surface facing the inside of the drum 10, and the rear surface 30*b* of the rear surface plate 30 refers to a surface facing the outside of the drum 10. A protruding portion 36 forming the flange groove 35 is formed on a front surface of the central portion 31 of the rear surface plate 30. Further, a circular wall 32 is formed on the rear surface 30*b* of the rear surface plate 30 along a circumference of the central portion 31. The circular wall 32 has an outer diameter corresponding to an inner diameter of the rear end of the drum 10. A plurality of rear surface holes 37 for fixing the flange shaft 70 are formed in the circular wall 32 connected to the flange groove 35.

The rear surface plate 30 is fixed to the rear end flange 12 of the drum 10 in a manner in which the circular wall 32 of the rear surface plate 30 is inserted into the rear opening to allow the edge 33 of the rear surface plate 30 to be in contact with the rear end flange 12 of the drum 10, and then the seaming portion 34 of the rear surface plate 30 is seamed to the rear end flange 12 of the drum 10.

The rear end positioning mechanism 40 is provided in the rear end flange 12 of the drum 10 and the rear surface plate 30, which is the same as in the embodiment described above, and a detailed description thereof is omitted. Hereinafter, only the front surface plate 20 and the front end positioning mechanism 50 having a different structure from that in the embodiment described above will be described.

Referring to FIG. 13A, the front surface plate 20 has a ring shape in which an opening 21 is formed at the center, and may be inserted into the front end of the drum 10, that is, into a front opening 15. For example, the front surface plate 20 may include a protruding portion 22 inserted into the front opening 15 of the drum 10 and having the circular opening 21, an edge 23 extending along an outer circumferential surface of the protruding portion 22 and having a shape corresponding to the front end flange 11 of the drum 10, and a seaming portion 24 vertically extending from the edge 23. The front surface plate 20 is fixed to the front end flange 11 of the drum 10 in a manner in which the protruding portion 22 of the front surface plate 20 is inserted into the front opening 15 of the drum 10 to allow the edge 23 of the front surface plate 20 to be in contact with the front end flange 11 of the drum 10, and then the seaming portion 24 of the front surface plate 20 is seamed to the front end flange 11 of the drum 10.

A ring-shaped groove 25 in which the ball balancer 60 is mounted is formed in a front surface of the protruding portion 22 of the front surface plate 20, that is, in an outer surface of the protruding portion 22 that does not face the drum 10. Further, a plurality of front surface holes 27 corresponding to a plurality of fixing holes 61 (see FIG. 19F) of the ball balancer 60 are formed in a side surface of the protruding portion 22. The plurality of fixing holes 61 are formed at predetermined intervals along an outer circumferential surface of the ball balancer 60, and accordingly, the plurality of front surface holes 27 are formed at predetermined intervals along the side surface of the protruding portion 22. For example, in case that six fixing holes 61 are formed in the ball balancer 60, six front surface holes 27 are formed at predetermined intervals in the circumferential direction in the protruding portion 22 of the front surface plate 20.

Further, the plurality of front end coupling holes 17 of the drum 10 are formed to correspond to the plurality of front surface holes 27 formed in the protruding portion 22 of the front surface plate 20. For example, the drum 10 may include six front end coupling holes 17 formed at predetermined intervals along the side surface of the drum 10 in a region adjacent to the front end flange 11 to correspond to six front surface holes 27 formed in the front surface plate 20.

Therefore, as the front surface plate 20 is inserted into the front opening 15 of the drum 10, and the plurality of front end coupling holes 17 of the drum 10, the plurality of front surface hole 27 of the front surface plate 20, and the plurality of fixing holes 61 of the ball balancer 60 are aligned with one another, the ball balancer 60 may be fixed to the drum 10 and the front surface plate 20 by fastening a fastening member such as a bolt or a screw to the plurality of front end coupling holes 17 of the drum 10.

The front end positioning mechanism 50 may position the front surface plate 20 to allow the plurality of front surface holes 27 of the front surface plate 20, for example, six front surface holes 27, to be aligned with the plurality of front end coupling holes 17 formed in the front end portion of the drum 10, for example, six front end coupling holes 17. The front end positioning mechanism 50 may be provided in the front end flange 11 of the drum 10 and the front surface plate 20.

For example, the front end positioning mechanism 50 may include two notches 51 formed in the front end flange 11 of the drum 10, and two protrusions 52 formed in the front surface plate 20 and coupled to the two notches 51, respectively.

The two notches 51 formed in the front end flange 11 of the drum 10 have a predetermined positional relationship with respect to the plurality of front end coupling holes 17 formed in the front end portion of the drum 10, and the two protrusions 52 formed in the front surface plate 20 have a predetermined positional relationship with respect to the plurality of front surface holes 27. Specifically, the positional relationship between the two protrusions 52 and the plurality of front surface holes 27 formed in the front surface plate 20 is the same as the positional relationship between the two notches 51 and the plurality of front end coupling holes 17 formed in the drum 10. Therefore, as the rear surface plate 20 is inserted into the front opening 15 of the drum 10 while allowing the two protrusions 52 of the front surface plate 20 to be inserted into the two notches 51 of the front end flange 11 of the drum 10, the plurality of front surface holes 27 of the front surface plate 20 and the plurality of front end coupling holes 17 of the drum 10 are aligned with each other.

Further, as the two protrusions 52 of the rear surface plate 20 are coupled to the two notches 51 formed in the front end flange 11 of the drum 10, respectively, it is possible to prevent the front surface plate 20 from rotating with respect to the front end flange 11 of the drum 10.

As illustrated in FIG. 12, the two notches 51 may each be a rectangular groove formed in an edge of the front end flange 11 of the drum 10. Further, the two notches 51 are formed to be spaced apart from each other by a predetermined distance in the circumferential direction in the front end flange 11 of the drum 10. Here, the two notches 51 are formed to be spaced apart from one front end coupling hole 17 formed in the front end portion of the drum 10 by a predetermined distance.

For example, as illustrated in FIG. 14A, one front end coupling hole 17 may be formed to be spaced apart from a first notch 51 formed in the front end flange 11 of the drum 10 by a first distance S1 in the circumferential direction, and a second notch 51 may be formed to be spaced apart from the first notch 51 by a second distance S3 in the circumferential direction.

The two protrusions 52 of the front surface plate 20 may each have a rectangular shape having a width G2 corresponding to a width G1 of each of the two notches 51 of the front end flange 11 of the drum 10. Further, the two protrusions 52 may be formed to be spaced apart from each other by a predetermined distance in the circumferential direction, in the front surface plate 20.

For example, one front end coupling hole 27 may be formed to be spaced apart from a first protrusion 52 formed in the edge 23 of the front surface plate 20 by a first distance S2 in the circumferential direction, and a second protrusion 52 may be formed to be spaced apart from the first protrusion 52 by a second distance S4 in the circumferential direction as illustrated in FIG. 14A. Here, the first distance S2 and the second distance S4 of the front surface plate 20 are the same as the first distance S1 and the second distance S3 of the drum 10, respectively (that is, S1=S2 and S3=S4).

For example, the two protrusions 52 are formed in the edge 23 of the front surface plate 20 as illustrated in FIG. 13A. The two protrusions 52 may each be formed by cutting a portion of the edge 23 of the front surface plate 20 in a "U"-letter shape with a flat bottom, that is, in a rectangular shape having one side surface connected to the edge 23, and bending the cut portion at a predetermined angle as illustrated in FIG. 13B. Here, a width G2 of the protrusion 52 having the rectangular shape may correspond to a width G1 of the notch 51 so that the protrusion 52 is inserted into the notch 51 and the positional relationship between the front surface holes 27 of the front surface plate 20 and the front end coupling holes 17 of the drum 10 is maintained.

As such, in case that two notches 51 are formed in the front end flange 11 of the drum 10, and two protrusions 52 corresponding to the two notches 51 are formed in the front surface plate 20, the two protrusions 52 of the front surface plate 20 may be inserted into and coupled to the two notches 51 of the front end flange 11 of the drum 10. Specifically, the front surface plate 20 is positioned to allow the two protrusions 52 to be aligned with the two notches 51 of the front end flange 11 of the drum 10 and then the front surface plate 20 is inserted to be in contact with the front end flange 11 of the drum 10 as illustrated in FIG. 14A. Then, the two protrusions 52 of the front surface plate 20 are inserted into the two notches 51 of the front end flange 11 of the drum 10, respectively, as illustrated in FIG. 14B. As such, as the protrusions 52 of the rear surface plate 20 are inserted into the notches 51 of the drum 10, respectively, the plurality of front surface holes 27 of the front surface plate 20 and the plurality of front end coupling holes 17 of the drum 10 are aligned with each other.

Although the case that the two notches 51 of the drum 10 are formed to be adjacent to one side of one coupling hole has been described above, the positions of the notches 51 are not limited thereto. The two notches 51 may be formed at various positions as long as positioning of the front surface plate 20 with respect to the drum 10 may be performed at the time of coupling.

Another example of the notch 51 of the drum 10 and the protrusion 52 of the front surface plate 20 will be described with reference to FIGS. 15A and 15B.

Figure 15A:
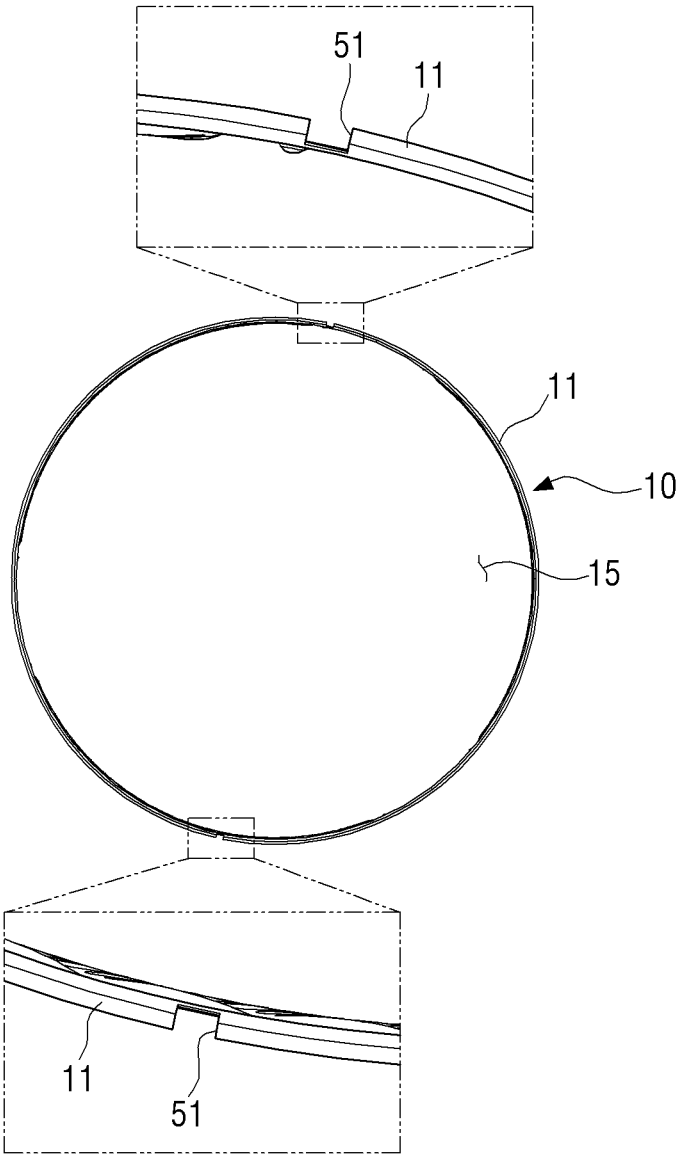
FIG. 15A is a view illustrating another example of the notch of the drum of the washing machine drum assembly according to another embodiment of the disclosure.
Figure 15B:
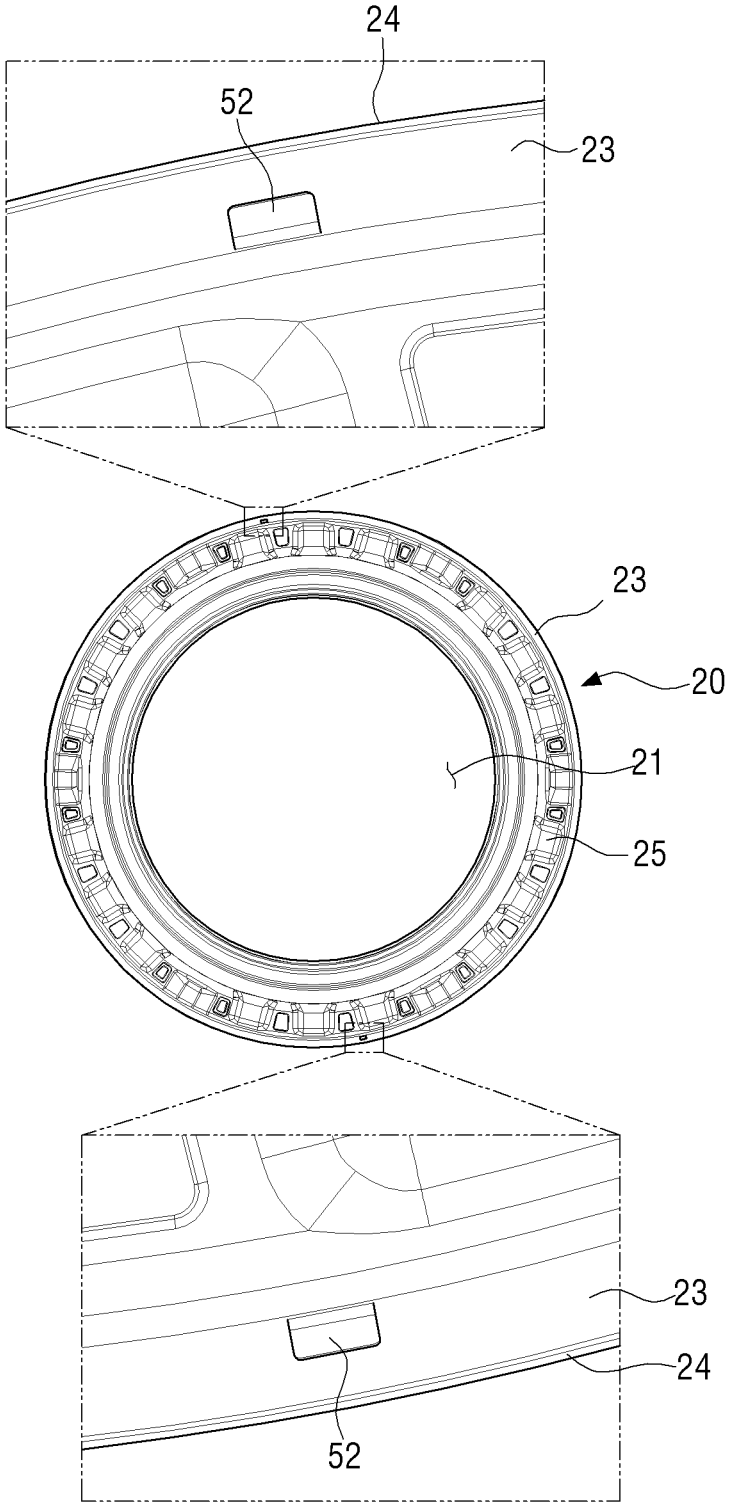
FIG. 15B is a view illustrating a protrusion of the front surface plate that is coupled to the notch of the drum of the washing machine drum assembly of FIG. 15A.

FIG. 15A is a view illustrating another example of the notch of the drum of the washing machine drum assembly according to another embodiment of the disclosure, and FIG. 15B is a view illustrating a protrusion of the front surface plate that is coupled to the notch of the drum of the washing machine drum assembly of FIG. 15A.

Referring to FIG. 15A, two notches 51 may be formed to be spaced at an interval of approximately 180 degrees around the center of the drum 10, in the front end flange 11 of the drum 10. Here, two protrusions 52 formed in the front surface plate 20 are formed at positions corresponding to the two notches 51 of the drum 10, respectively. That is, the two protrusions 52 may be formed to be spaced at an interval of approximately 180 degrees around the center of the front surface plate 20, in the edge 23 of the front surface plate 20 as illustrated in FIG. 15B.

Further, chamfering may be performed on an inlet portion of the notch 51 formed in the front end flange 11 of the drum 10, similarly to the case of the notch 41 of the rear end flange 12 as illustrated in FIG. 7. In case that the chamfering is performed on the notch 51 of the front end flange 11 as described above, the protrusion 52 of the front surface plate 20 may be easily inserted into the notch 51 of the front end flange 11 of the drum 10 at the time of inserting the front surface plate 20 into the front opening 15 of the drum 10.

Although the case that the front end positioning mechanism 50 includes two notches 51 and two protrusions 52 has been described above, the numbers of notches 51 and protrusions 52 configuring the front end positioning mechanism 50 are not limited thereto. The front end positioning mechanism 50 is used to prevent rotation of the front surface plate 20 with respect to the drum 10 and determine a position where the front surface plate 20 is inserted, and thus the numbers of notches 51 and protrusions 52 configuring the front end positioning mechanism 50 may each be one. In other words, the numbers of notches 51 and protrusions 52 configuring the front end positioning mechanism 50 may each be at least one.

Although the case that the front end positioning mechanism 50 is configured with the notch 51 formed in the front end flange 11 of the drum 10 and the protrusion 52 formed in the front surface plate 20 has been described above, but the front end positioning mechanism 50 is not limited thereto. The front end positioning mechanism 50 may also have a structure that is reverse to that described above. Hereinafter, the front end positioning mechanism having the reverse structure will be described with reference to FIGS. 16 and 17.

Figure 16:
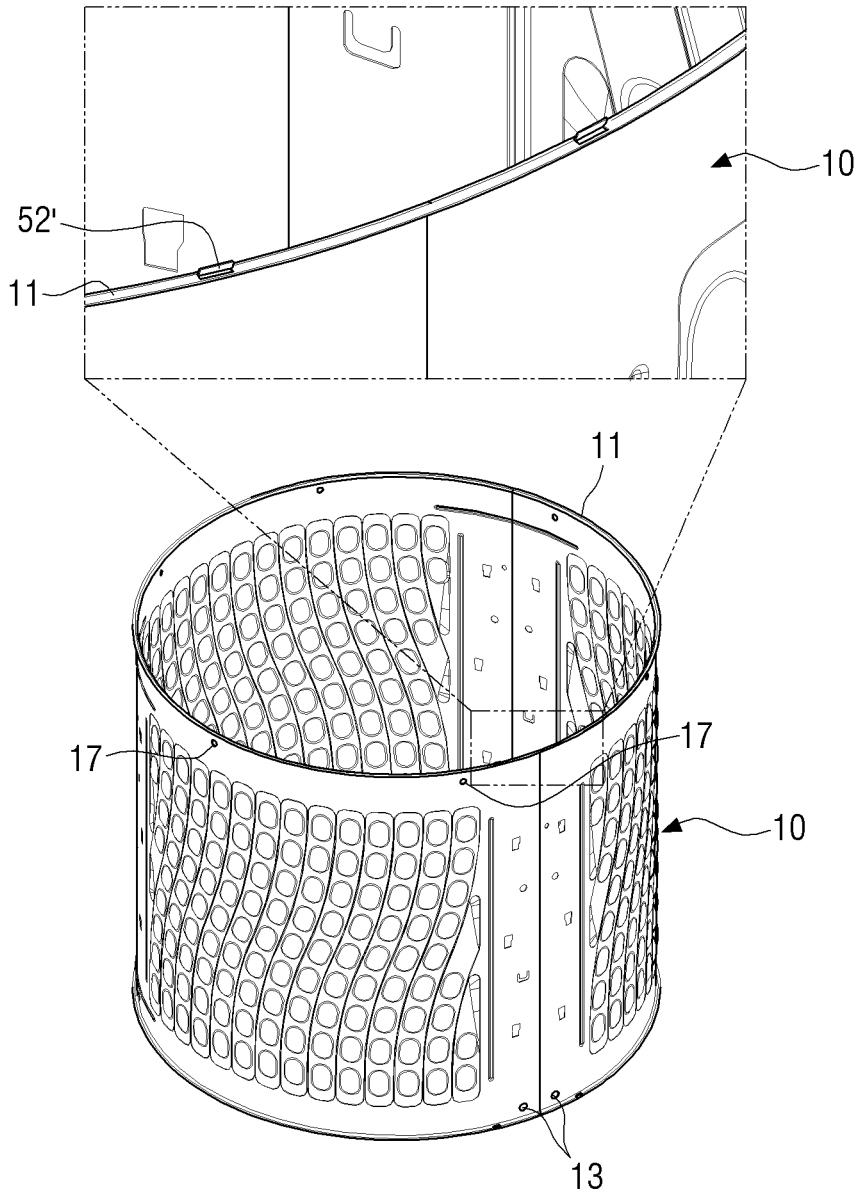
FIG. 16 is a perspective view illustrating the drum of the washing machine drum assembly according to another embodiment of the disclosure.
Figure 17:
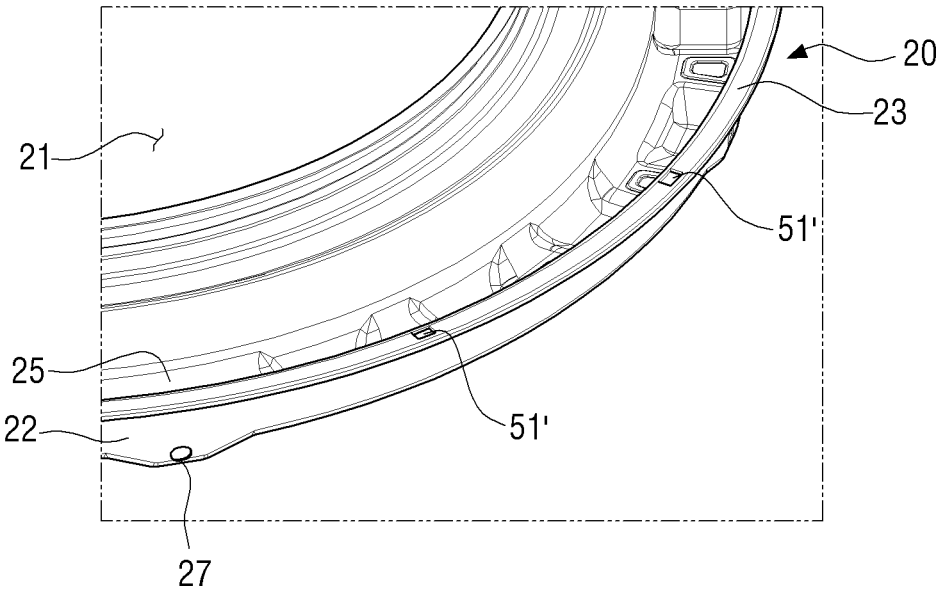
FIG. 17 is a perspective view illustrating the front surface plate coupled to the drum of the washing machine drum assembly of FIG. 16.

FIG. 16 is a perspective view illustrating the drum of the washing machine drum assembly according to another embodiment of the disclosure, and FIG. 17 is a perspective view illustrating the front surface plate coupled to the drum of the washing machine drum assembly of FIG. 16.

The front end positioning mechanism 50 of the washing machine drum assembly 1 according to the embodiment includes two protrusions 52' formed in the front end flange 11 of the drum 10 and two notches 51' formed in the front surface plate 20.

Referring to FIG. 16, the two protrusions 52' may be formed in the front end flange 11 of the drum 10 to be able to be inserted into and coupled to the two notches 51' formed in the front surface plate 20. The two protrusions 52' are formed to be spaced apart from each other by a predetermined distance in the circumferential direction in the front end flange 11.

A shape of each of the two protrusions 52' formed in the drum 10 is similar to that of the protrusion 52 formed in the front surface plate 20 of the front end positioning mechanism 50 according to the embodiment described above, and thus a detailed description thereof is omitted. Further, positions of the two protrusions 52' are the same as those of the two notches 51 of the front end positioning mechanism 50 according to the embodiment described above that are formed in the front end flange 11 of the drum 10, and thus a detailed description thereof is omitted. The two protrusions 52' of the front end flange 11 of the drum 10 have a predetermined positional relationship with the plurality of front end coupling holes 17 of the drum 10.

Referring to FIG. 17, the two notches 51' are formed in the front surface plate 20 to allow the two protrusions 52' to be inserted thereinto, the two protrusions 52' being formed in the front end flange 11 of the drum 10. The two notches 51' are formed to be spaced apart from each other by a predetermined distance in the circumferential direction in the edge 23 of the front surface plate 20.

The two notches 51' may each be a rectangular through-hole formed in the edge 23 of the front surface plate 20. Further, positions of the two notches 51' are the same as those of the two protrusions 52 of the front end positioning mechanism 50 according to the embodiment described above that are formed in the front surface plate 20, and thus a detailed description thereof is omitted. Accordingly, a positional relationship between the two notches 51' and the plurality of front surface holes 27 of the front surface plate 20 is the same as the positional relationship between the two protrusions 52' and the plurality of front end coupling holes 17 of the drum 10.

Therefore, once the front surface plate 20 is inserted into the front opening 15 of the drum 10 in a state in which the two notches 51' of the front surface plate 20 are aligned with the two protrusions 52' of the front end flange 11 of the drum 10, the two protrusions 52' of the drum 10 are inserted into the two notches 51' of the front surface plate 20. As a result, it is possible to prevent the front surface plate 20 from slipping or rotating with respect to the drum 10 in the circumferential direction. Further, the plurality of front surface holes 27 of the front surface plate 20 and the plurality of front end coupling holes 17 of the drum 10 are aligned with each other.

Although the case that the front end positioning mechanism 50 includes the notches 51 or 51' and the protrusions 52 or 52' has been described above, the structure of the front end positioning mechanism 50 is not limited thereto. The front end positioning mechanism 50 may have various structures similarly to the rear end positioning mechanism 40 illustrated in FIGS. 10A to 11B.

In the washing machine drum assembly 1 having the above-described structure according to an embodiment of the disclosure, the front surface plate 20 and the rear surface plate 30 are coupled to the drum 10 by using the front end positioning mechanism 50 and the rear end positioning mechanism 40, respectively, and thus the plurality of front surface holes 27 of the front surface plate 20 are not misaligned with the plurality of front end coupling holes 17 of the drum 10, and the plurality of rear surface holes 37 of the rear surface plate 30 are not misaligned with the coupling holes 13 of the drum 10. Therefore, in a process of producing the washing machine drum assembly 1, it is possible to prevent a bolt or a screw from being unfastened or being incompletely fastened at the time of fastening the ball balancer 60 mounted on the front surface plate 20 and the flange shaft 70 mounted on the rear surface plate 30 by using the bolt or the screw.

Further, in the above-described washing machine drum assembly 1 according to an embodiment of the disclosure, the front surface plate 20 and the rear surface plate 30 are coupled to the drum 10 by using the front end positioning mechanism 50 and the rear end positioning mechanism 40, respectively, and thus it is possible to prevent the front surface plate 20 and the rear surface plate 30 from slipping and rotating with respect to the drum 10 at the time of fixing the front surface plate 20 and the rear surface plate 30 to the front end flange 11 and the rear end flange 12 of the drum 10, respectively, by seaming.

Hereinafter, a washing machine including the above-described washing machine drum assembly according to an embodiment of the disclosure will be described with reference to FIG. 18.

Figure 18:
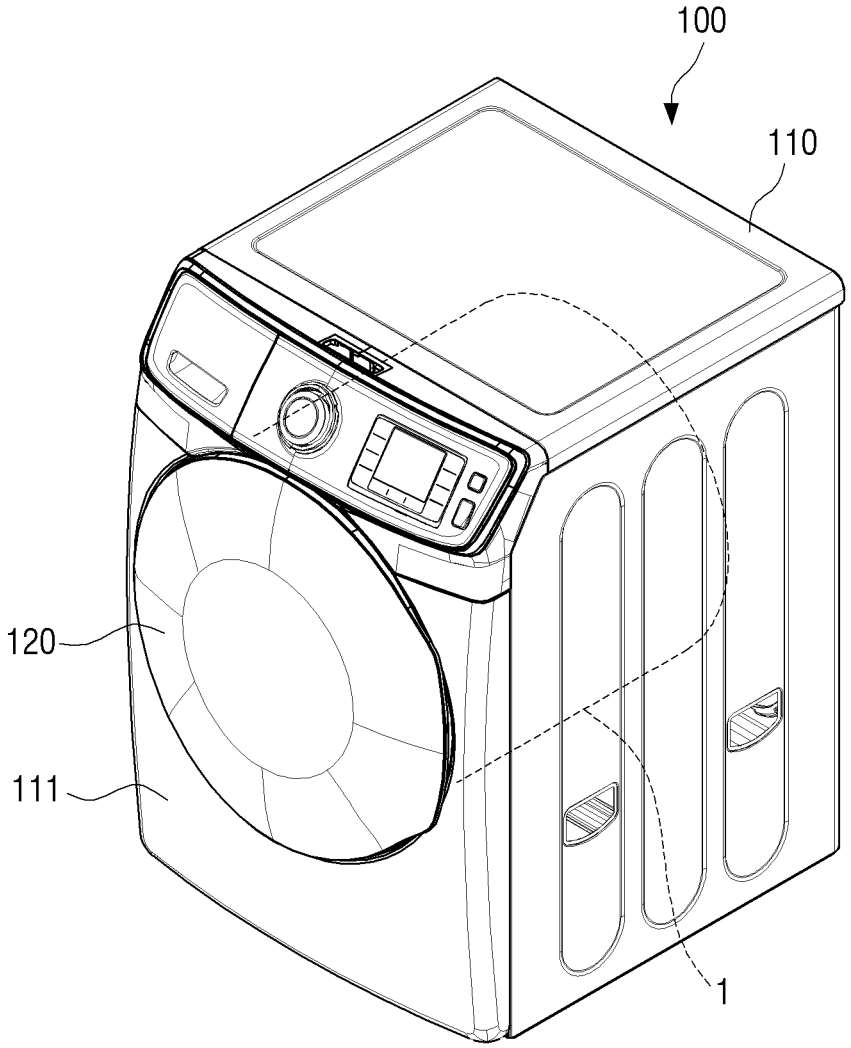
FIG. 18 is a perspective view illustrating a washing machine in which a washing machine drum assembly according to an embodiment of the disclosure is mounted.

FIG. 18 is a perspective view illustrating a washing machine in which the washing machine drum assembly according to an embodiment of the disclosure is mounted.

Referring to FIG. 18, a washing machine 100 may include a body 110, the drum assembly 1 mounted in the body 110, and a door 120 mounted on a front surface 111 of the body 110 and configured to open and close an opening of the front surface 111 of the body 110.

The front surface 111 of the body 110 has the opening to load or unload laundry, and the door 120 is mounted on the front surface 111 of the body 110 by using a hinge to open and close the opening formed in the front surface 111 of the body 110.

The drum assembly 1 is mounted inside the body 110. The drum assembly 1 is mounted while allowing the front opening 15 of the drum 10 to face the opening of the front surface of the body 110. Further, a rotating tub (not illustrated) is rotatably mounted in the drum assembly 1. The rotating tub has a cylindrical container shape with one end opened. The rotating tub may rotate by receiving power from the flange shaft 70 mounted on the rear surface plate 30 of the drum assembly 1.

Once the door 120 is open, the inside of the rotating tub is open and laundry may be loaded into or unloaded from the inside of the rotating tub through the opening of the front surface of the body 110. Once the door 120 is closed, the opening of the front surface of the body 110 is closed and one end of the rotating tub is closed to perform a laundering process.

A structure of the washing machine 100 is the same as that of the washing machine according to the related art except that the drum assembly 1 according to an embodiment of the disclosure is used as a washing tub, and thus a detailed description thereof is omitted.

Although the drum washing machine 100 in which the drum assembly 1 is mounted in a horizontal direction has been illustrated and described in FIG. 18, the washing machine drum assembly 1 according to an embodiment of the disclosure may also be applied to a full-automatic washing machine (not illustrated) in which the drum assembly 1 is mounted in a vertical direction.

Hereafter, a process of producing the washing machine drum assembly according to an embodiment of the disclosure will be described with reference to FIGS. 19A to 19I.

FIGS. 19A to 19I are views illustrating a process of producing the washing machine drum assembly according to an embodiment of the disclosure.

Figure 19A:
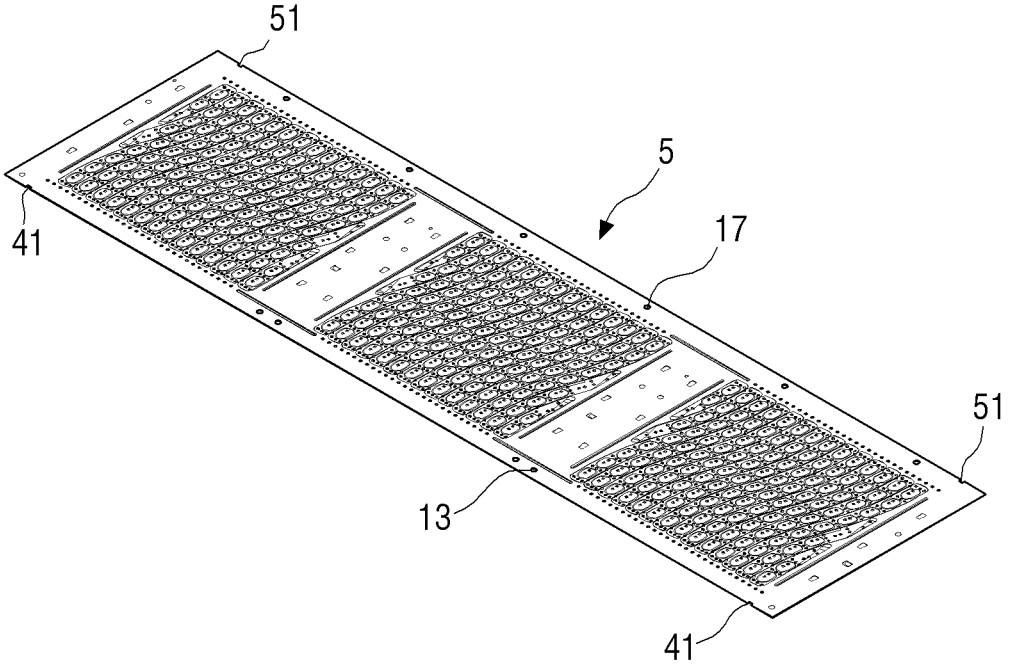
FIGS. 19A to 19I are views illustrating a process of producing the washing machine drum assembly according to an embodiment of the disclosure.

First, as illustrated in FIG. 19A, a drum sheet 5 having a flat plate shape is processed to form a drum 10. The drum sheet 5 is formed by cutting a metal plate such as a stainless steel plate and performing press processing.

A plurality of front end coupling holes 17 for fixing a ball balancer 60 and a plurality of coupling holes 13 for fixing a flange shaft 70 may be formed in the drum sheet 5. Further, at least one notch 51 of a front end positioning mechanism 50 and at least one notch 41 of a rear end positioning mechanism 40 may be formed in the drum sheet 5.

Here, the at least one notch 51 of the front end positioning mechanism 50 has a predetermined positional relationship with the plurality of front end coupling holes 17 formed in the drum sheet 5, and the at least one notch 41 of the rear end positioning mechanism 40 has a predetermined positional relationship with the plurality of coupling holes 13 formed in the drum sheet 5. Such a positional relationship is the same as that of the washing machine drum assembly 1 described above, and thus a detailed description thereof is omitted.

Although FIG. 19A illustrates the case that at least one notch 51 of the front end positioning mechanism 50 is formed in the drum sheet 5, there is no need to form at least one notch 51 of the front end positioning mechanism 50 in the drum sheet 5 in case of a washing machine in which the ball balancer 60 is not used.

Figure 19B:
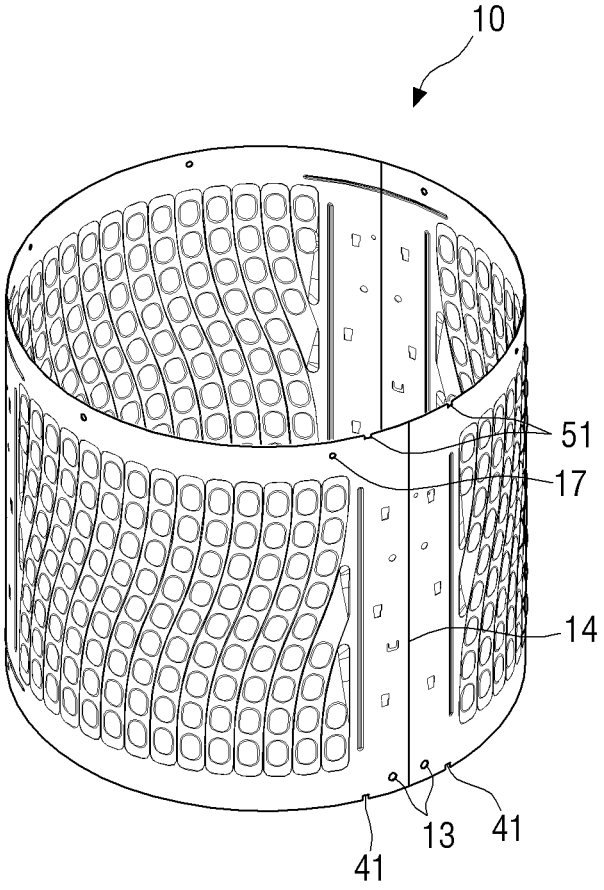

Then, as illustrated in FIG. 19B, the drum sheet 5 is processed into the drum 10. Specifically, the drum 10 is formed by bending the drum sheet 5 in a cylindrical shape while making opposite side ends of the drum sheet 5 come into contact with each other and then bonding the opposite side ends of the drum sheet 5 that are in contact with each other by welding.

Figure 19C:
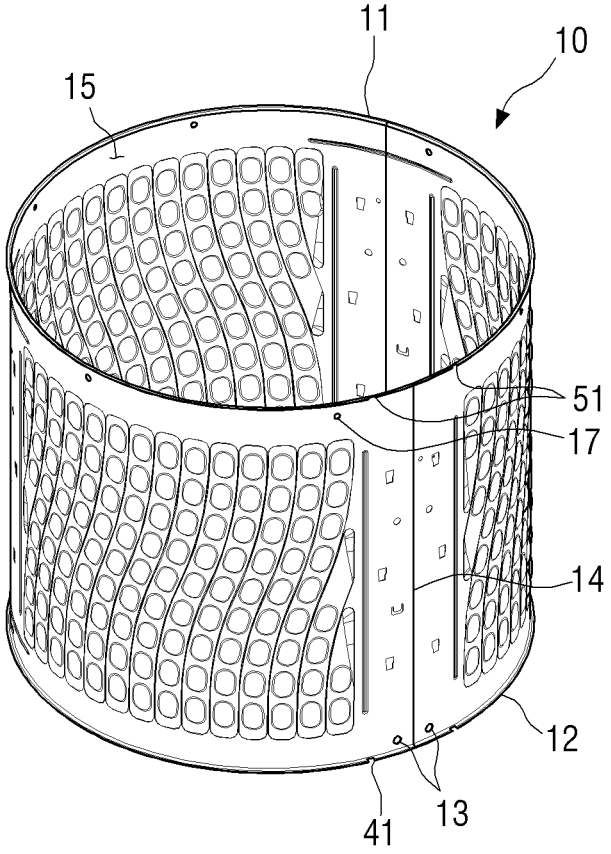

Then, as illustrated in FIG. 19C, a front end flange 11 and a rear end flange 12 are formed at opposite ends of the drum 10, respectively. Specifically, the front end flange 11 and the rear end flange 12 are formed at the front end and the rear end of the drum 10, respectively, by bending the opposite ends of the drum 10 at 90 degrees with a bending machine. In this case, two notches 51 of the front end positioning mechanism 50 are positioned in the front end flange 11 and two notches 41 of the rear end positioning mechanism 40 are positioned in the rear end flange 12.

Meanwhile, the front surface plate 20 and the rear surface plate 30 are produced separately from the drum 10. The front surface plate 20 and the rear surface plate 30 may also be formed by press processing.

At least one protrusion 52 of the front end positioning mechanism 50 may be formed at the time of producing the front surface plate 20. That is, a plurality of front surface holes 27 and at least one protrusion 52 are formed in the front surface plate 20, the plurality of front surface holes 27 corresponding to the plurality of front end coupling holes 17 of the drum 10 and the at least one protrusion 52 corresponding to the at least one notch 51 formed in the front end flange 11. Here, a positional relationship between the at least one protrusion 52 and the plurality of front surface holes 27 formed in the front surface plate 20 is the same as the above-described positional relationship between the at least one notch 51 of the front end flange 11 and the plurality of front end coupling holes 17 of the drum 10.

Further, at least one protrusion 41 of the rear end positioning mechanism 40 may be formed at the time of producing the rear surface plate 30. That is, a plurality of rear surface holes 37 and at least one protrusion 42 are formed in the rear surface plate 30, the plurality of rear surface holes 37 corresponding to the plurality of coupling holes 13 of the drum 10 and the at least one protrusion 42 corresponding to the at least one notch 41 formed in the rear end flange 12. Here, a positional relationship between the at least one protrusion 42 and the plurality of rear surface holes 37 formed in the rear surface plate 30 is the same as the above-described positional relationship between the at least one notch 41 of the rear end flange 12 and the plurality of coupling holes 13 of the drum 10.

Figure 19D:
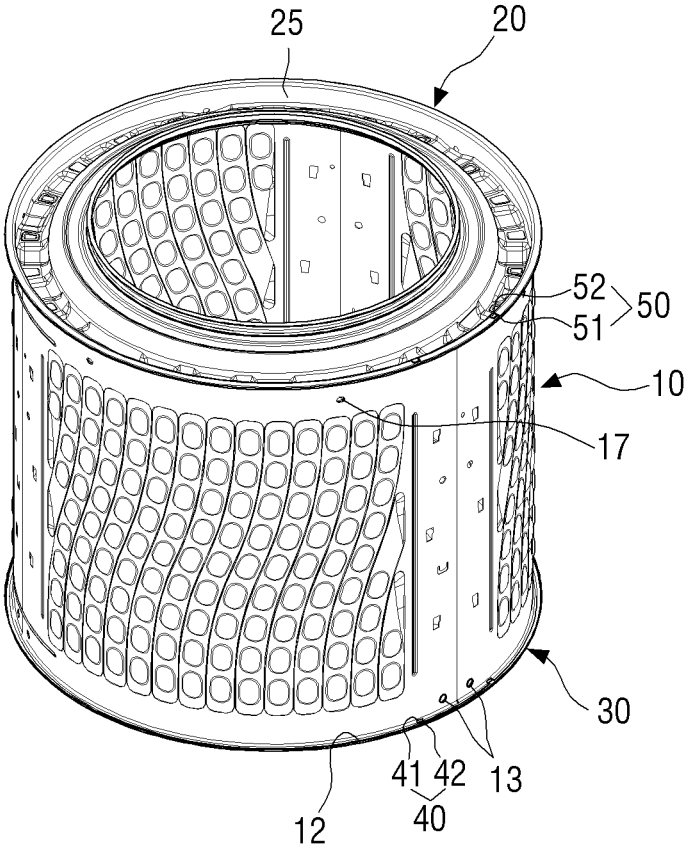

Then, the front surface plate 20 is inserted into the front end of the drum 10, that is, into a front opening 15 at which the front end flange 11 is provided, as illustrated in FIG. 19D. Here, the front surface plate 20 is coupled to the front end of the drum 10 after making the at least one protrusion 52 of the front surface plate 20 be aligned with the at least one notch 51 of the front end flange 11 of the drum 10. In this case, the plurality of front surface holes 27 of the front surface plate 20 are aligned with the plurality of front end coupling holes 17 of the drum 10.

Further, the rear surface plate 30 is inserted into the rear end of the drum 10, that is, into a rear opening at which the rear end flange 12 is provided. Here, the rear surface plate 30 is coupled to the rear end of the drum 10 after making the at least one protrusion 42 of the rear surface plate 30 be aligned with the at least one notch 41 of the rear end flange 12 of the drum 10. In this case, the plurality of rear surface holes 37 of the rear surface plate 30 are aligned with the plurality of coupling holes 13 of the drum 10.

Figure 19E:
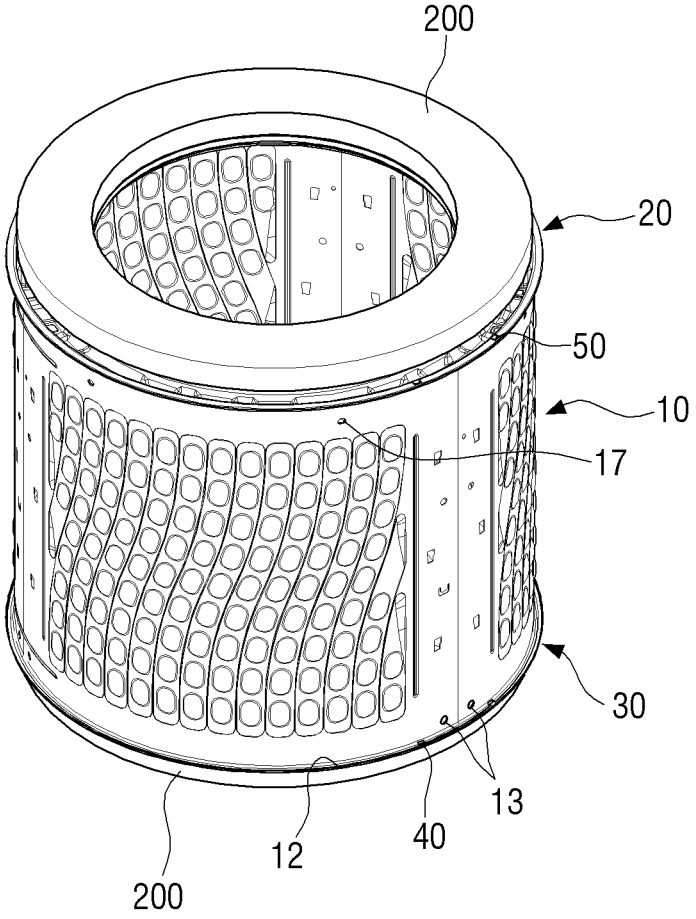

Next, as illustrated in FIG. 19E, the drum 10 into which the front surface plate 20 and the rear surface plate 30 are inserted is mounted on a seaming jig 200, and the front surface plate 20 and the rear surface plate 30 are coupled to the drum 10 by using the seaming jig 200. Specifically, by using the seaming jig 200, a seaming portion 24 of the front surface plate 20 is seamed to the front end flange 11 of the drum 10, and a seaming portion 34 of the rear surface plate 30 is seamed to the rear end flange 12 of the drum 10. Then, the front surface plate 20 and the rear surface plate 30 are fixed to the front end flange 11 and the rear end flange 12 of the drum 10, respectively.

Figure 19F:
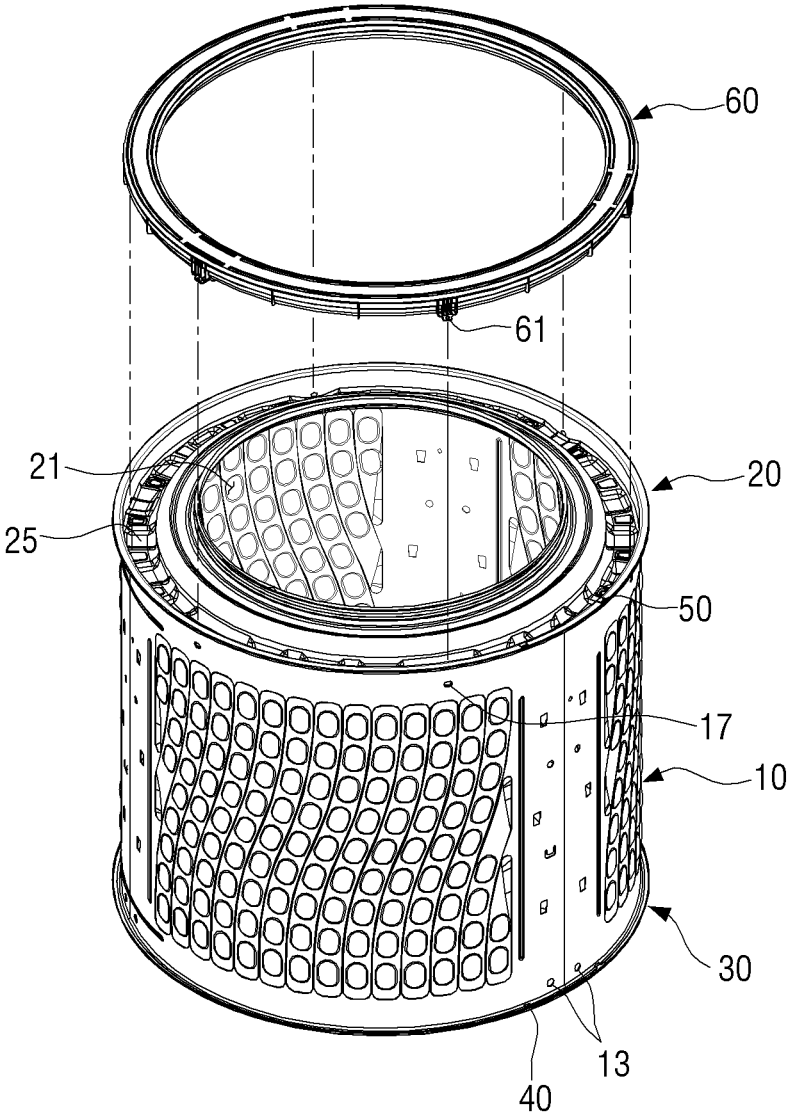

Next, as illustrated in FIG. 19F, the ball balancer 60 is mounted on the front surface plate 20. Specifically, the ball balancer 60 is inserted into a ring-shaped groove 25 formed in a front surface of a protruding portion of the front surface plate 20. Here, a plurality of fixing holes 61 of the ball balancer 60 are aligned with the plurality of front surface holes 27 of the front surface plate 20. As the plurality of fixing holes 61 of the ball balancer 60 are aligned with the plurality of front surface holes 27 of the front surface plate 20, the plurality of fixing holes 61 of the ball balancer 60 are aligned with the front end coupling holes 17 of the drum 10.

Figure 19G:
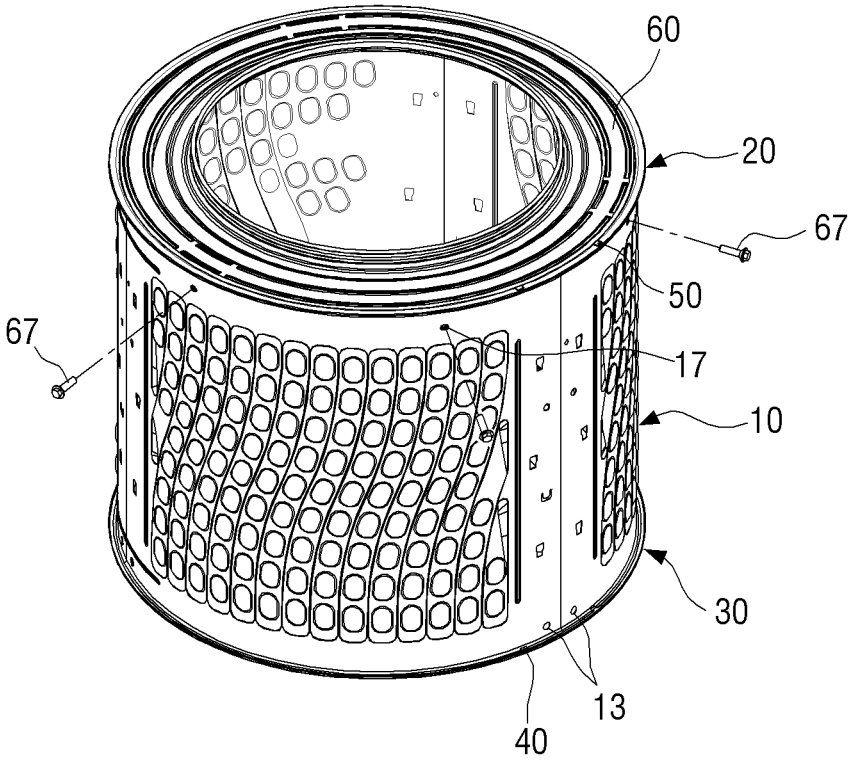

Next, as illustrated in FIG. 19G a plurality of screws or bolts 67 are fastened to the front end coupling holes 17 of the drum 10. In this case, because the front end coupling holes 17 of the drum 10, the plurality of front surface holes 27 of the front surface plate 20, and the plurality of fixing holes 61 of the ball balancer 60 are aligned with one another, the drum 10, the front surface plate 20, and the ball balancer 60 may be integrally coupled by fastening the screws 67 to the front end coupling holes 17 of the drum 10.

Figure 19H:
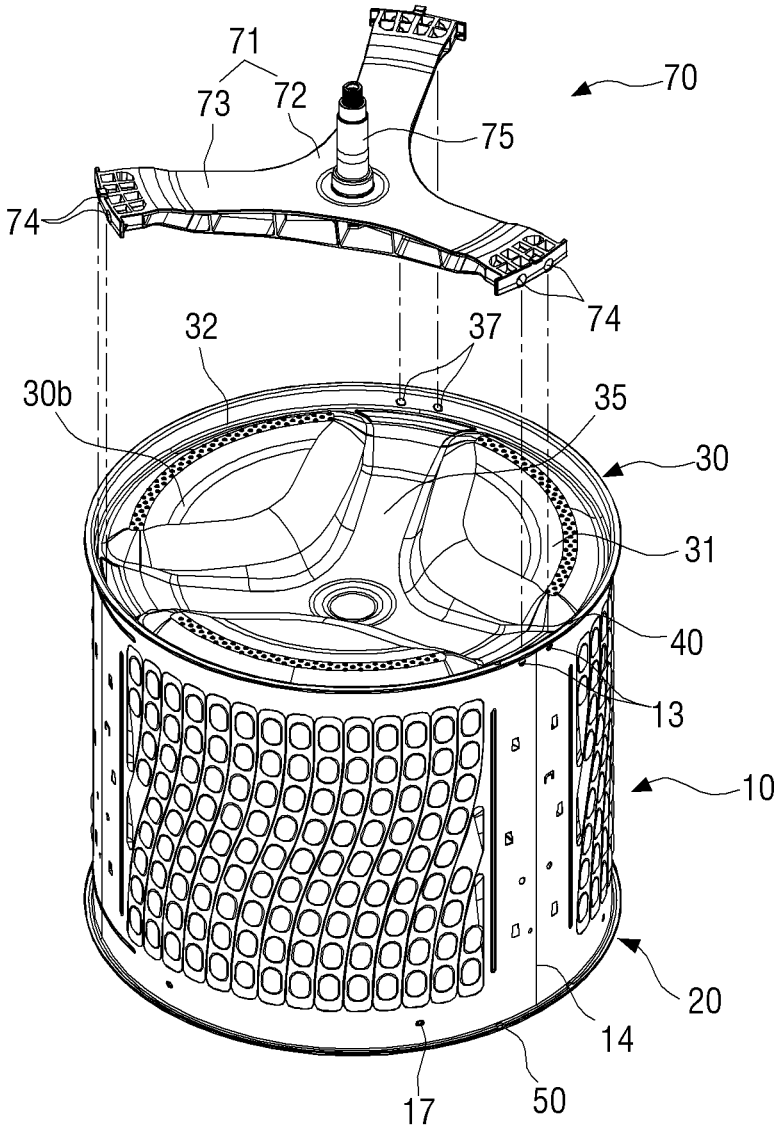

Next, as illustrated in FIG. 19H, the flange shaft 70 is mounted on the rear surface plate 30. Specifically, the flange shaft 70 is inserted into a flange groove 35 formed in a rear surface 30*b* of the rear surface plate 30. Then, a plurality of fastening holes 74 formed in three leg portions 73 of the flange shaft 70 are aligned with the plurality of rear surface holes 37 formed in a side surface of the flange groove 35 of the rear surface plate 30. As the plurality of fastening holes 74 of the flange shaft 70 are aligned with the plurality of rear surface holes 37 of the rear surface plate 30, the plurality of fastening holes 74 of the flange shaft 70 are aligned with the coupling holes 13 of the drum 10.

Figure 19I:
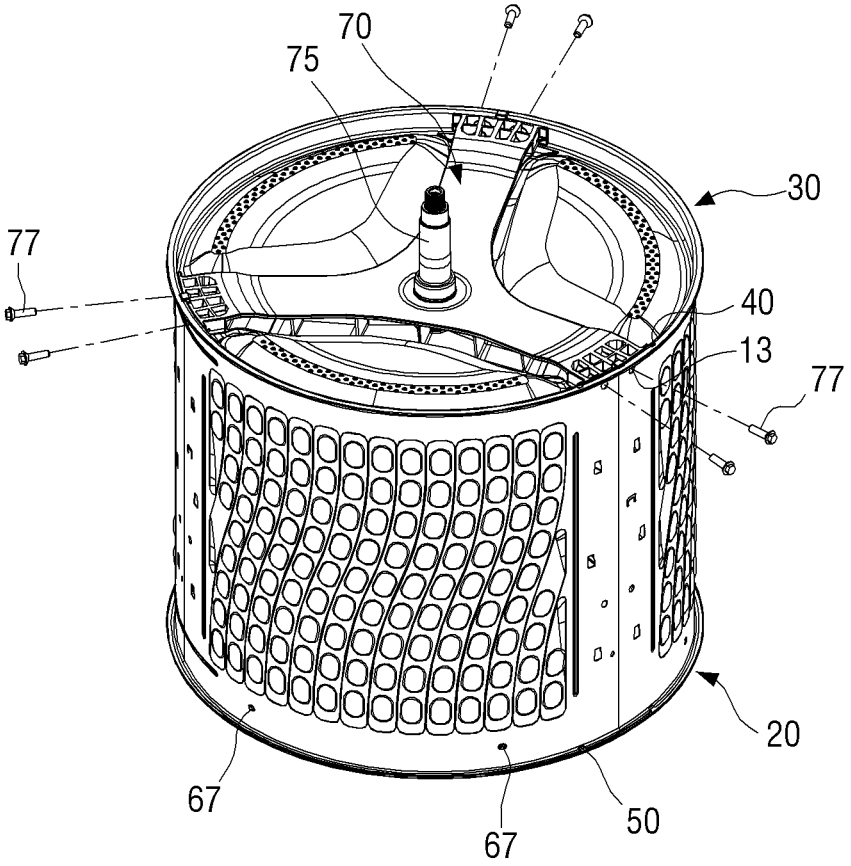

Next, as illustrated in FIG. 19I, a plurality of screws or bolts 77 are fastened to the coupling holes 13 of the drum 10. In this case, because the coupling holes 13 of the drum 10, the plurality of rear surface holes 37 of the rear surface plate 30, and the plurality of fastening holes 74 of the flange shaft 70 are aligned with one another, the drum 10, the rear surface plate 30, and the flange shaft 70 may be integrally coupled by fastening the screws 77 to the coupling holes 13 of the drum 10.

In the washing machine drum assembly having the above-described structure according to an embodiment of the disclosure, the front surface plate and the rear surface plate are coupled to the drum by using the front end positioning mechanism and the rear end positioning mechanism, and thus the plurality of front surface holes of the front surface plate are not misaligned with the plurality of front end coupling holes of the drum, and the plurality of rear surface holes of the rear surface plate are not misaligned with the coupling holes. Therefore, in a process of producing the washing machine drum assembly, it is possible to prevent a bolt or a screw from being unfastened or being incompletely fastened at the time of fastening the ball balancer mounted on the front surface plate and the flange shaft mounted on the rear surface plate by using the bolt or the screw.

Further, in the washing machine drum assembly having the above-described structure according to an embodiment of the disclosure, the front surface plate and the rear surface plate are coupled to the drum by using the front end positioning mechanism and the rear end positioning mechanism, and thus it is possible to prevent the front surface plate and the rear surface plate from slipping and rotating with respect to the drum at the time of fixing the front surface plate and the rear surface plate to the front end flange and the rear end flange of the drum, respectively, by seaming.

Hereinabove, the disclosure has been described for illustrative purpose. It is to be understood that terms used herein are provided to describe the disclosure rather than limiting the disclosure. Various modifications and alternations of the disclosure may be made according to the contents described above. Therefore, the disclosure may be freely practiced without departing from the scope of the claims unless additionally mentioned.

What is claimed is:

1. A washing machine drum assembly comprising:

a drum having a hollow cylindrical shape, and including a front end flange formed at a front end of the drum and a rear end flange formed at a rear end of the drum, the drum including a plurality of coupling holes formed adjacent to the rear end flange;

a front surface plate inserted into a front opening of the front end of the drum and mounted on the front end of the drum; and a rear surface plate inserted into a rear opening of the rear end of the drum and mounted on the rear end of the drum, and the rear surface plate including a plurality of rear surface holes corresponding to the plurality of coupling holes of the drum, wherein each of the front end flange and the rear end flange of the drum extends approximately 90 degrees outward from a side surface of the drum, wherein the rear surface plate includes an edge formed in a shape corresponding to the rear end flange of the drum and a seaming portion extending vertically from the edge, and the rear surface plate is coupled to the rear end flange by the edge and the seaming portion, wherein a rear end positioning mechanism configured to position the rear surface plate with respect to the drum is formed in the rear end flange of the drum and the rear surface plate, and wherein the rear end positioning mechanism comprises at least one notch or protrusion formed in the rear end flange of the drum and at least one protrusion or notch formed in the edge of the rear surface plate and coupled to the at least one notch or protrusion of the rear end flange.

2. The washing machine drum assembly as claimed in claim 1, wherein the rear end positioning mechanism includes:

the at least one notch formed in the rear end flange of the drum and having a predetermined positional relationship with the plurality of coupling holes; and the at least one protrusion formed in the rear surface plate and coupled to the at least one notch to prevent the rear surface plate from rotating with respect to the rear end flange, and wherein a positional relationship between the at least one protrusion and the plurality of rear surface holes of the rear surface plate is equal to the positional relationship between the at least one notch and the plurality of coupling holes of the drum.

3. The washing machine drum assembly as claimed in claim 2, wherein the at least one notch of the rear end flange of the drum has a rectangular shape, and wherein the at least one protrusion of the rear surface plate has a rectangular shape having a width corresponding to a width of the at least one notch.

4. The washing machine drum assembly as claimed in claim 2, wherein an inlet of the at least one notch of the rear end flange of the drum is chamfered.

5. The washing machine drum assembly as claimed in claim 1, wherein the rear end positioning mechanism includes:

two notches formed in the rear end flange of the drum and spaced apart from the plurality of coupling holes by a predetermined distance in a circumferential direction; and two protrusions formed in the rear surface plate and coupled to the two notches, respectively, to prevent the rear surface plate from rotating with respect to the rear end flange, and wherein a positional relationship between the two protrusions and the plurality of rear surface holes of the rear surface plate is equal to a positional relationship between the two notches and the plurality of coupling holes of the drum.

6. The washing machine drum assembly as claimed in claim 5, wherein the two notches are line symmetric with respect to a weld line formed in a side surface of the drum.

7. The washing machine drum assembly as claimed in claim 5, wherein the two notches are formed to be spaced at an interval of 180 degrees in the circumferential direction in the rear end flange of the drum.

8. The washing machine drum assembly as claimed in claim 1, wherein the rear end positioning mechanism includes:

the at least one notch formed in the rear surface plate; and the at least one protrusion formed in the rear end flange of the drum and coupled to the at least one notch to prevent the rear surface plate from rotating with respect to the rear end flange, wherein the at least one protrusion of the rear end flange of the drum has a predetermined positional relationship with the plurality of coupling holes, and a positional relationship between the at least one notch and the plurality of rear surface holes of the rear surface plate is equal to the positional relationship between the at least one protrusion and the plurality of coupling holes of the drum.

9. The washing machine drum assembly as claimed in claim 1, wherein a flange shaft is mounted on the rear surface plate, and a plurality of fastening holes corresponding to the plurality of rear surface holes of the rear surface plate are formed in a side surface of a flange of the flange shaft.

10. The washing machine drum assembly as claimed in claim 1, further comprising a front end positioning mechanism formed in the front end flange of the drum and the front surface plate, and configured to position the front surface plate with respect to the drum, wherein the drum includes a plurality of front end coupling holes formed adjacent to the front end flange, and the front surface plate includes a plurality of front surface holes corresponding to the plurality of front end coupling holes of the drum.

11. The washing machine drum assembly as claimed in claim 10, wherein the front end positioning mechanism includes:

at least one notch formed in the front end flange of the drum and having a predetermined positional relationship with the plurality of front end coupling holes; and at least one protrusion formed in the front surface plate and coupled to the at least one notch to prevent the front surface plate from rotating with respect to the front end flange, and wherein a positional relationship between the at least one protrusion and the plurality of front surface holes of the front surface plate is equal to the positional relationship between the at least one notch and the plurality of front end coupling holes of the drum.

12. The washing machine drum assembly as claimed in claim 11, wherein the at least one notch of the front end flange of the drum has a rectangular shape, and the at least one protrusion of the front surface plate has a rectangular shape having a width corresponding to a width of the at least one notch.

13. The washing machine drum assembly as claimed in claim 10, wherein the front end positioning mechanism includes:

at least one notch formed in the front surface plate; and at least one protrusion formed in the front end flange of the drum and coupled to the at least one notch to prevent the front surface plate from rotating with respect to the front end flange, wherein the at least one protrusion of the front end flange of the drum has a predetermined positional relationship with the plurality of front end coupling holes, and a positional relationship between the at least one notch and the plurality of front surface holes of the front surface plate is equal to the positional relationship between the at least one protrusion and the plurality of front end coupling holes of the drum.

14. The washing machine drum assembly as claimed in claim 10, wherein a ball balancer is mounted on the front surface plate.

15. A washing machine comprising the washing machine drum assembly as claimed in claim 1.

* * * * *